US008224200B2

(12) United States Patent
Ishida

(10) Patent No.: US 8,224,200 B2
(45) Date of Patent: Jul. 17, 2012

(54) IMAGE FORMING APPARATUS FOR CONTROLLING SPEED OF INTERMEDIATE TRANSFER MEMBER ACCORDING TO IMAGE

(75) Inventor: Satoshi Ishida, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 357 days.

(21) Appl. No.: 12/547,741

(22) Filed: Aug. 26, 2009

(65) Prior Publication Data

US 2010/0054783 A1 Mar. 4, 2010

(30) Foreign Application Priority Data

Aug. 29, 2008 (JP) ..... 2008-222024

(51) Int. Cl.
*G03G 15/16* (2006.01)

(52) U.S. Cl. ..... 399/66

(58) Field of Classification Search ..... 399/66, 399/302, 308; 358/1.15
See application file for complete search history.

(56) References Cited

U.S. PATENT DOCUMENTS

2007/0052998 A1 3/2007 Tsunekawa

FOREIGN PATENT DOCUMENTS

| | | | | |
|---|---|---|---|---|
| JP | 3-282572 | | | 12/1991 |
| JP | 7-184019 | A | | 7/1995 |
| JP | 09127847 | A | * | 5/1997 |
| JP | 2000200023 | A | * | 7/2000 |
| JP | 2001281955 | A | * | 10/2001 |
| JP | 2007-69357 | | | 3/2007 |

* cited by examiner

*Primary Examiner* — Quana M Grainger
(74) *Attorney, Agent, or Firm* — Canon USA, Inc., IP Division

(57) ABSTRACT

A color image forming apparatus includes one image bearing member, an image forming unit configured to successively form images with toners in plural different colors on the image bearing member per color, a revolving intermediate transfer member, and a transfer unit configured to successively transfer the images on the image bearing member onto the intermediate transfer member in a superimposed relation in a transfer section. Images are transferred in a superimposed relation by executing control such that, when formation of the next image is not started at a due timing of starting the formation of the next image, a timing at which transfer is started after the formation of the next image and a timing at which a leading end of the previously transferred image reaches the transfer section are matched with each other by temporarily changing the revolving speed of the intermediate transfer member or stopping it.

18 Claims, 12 Drawing Sheets

IMAGE FORMING APPARATUS FOR CONTROLLING SPEED OF INTERMEDIATE TRANSFER MEMBER ACCORDING TO IMAGE

BACKGROUND OF THE INVENTION

1. Field of the Invention

The present invention relates to an image forming apparatus, such as a copying machine, a laser beam printer, or a facsimile.

2. Description of the Related Art

In a known image forming apparatus, such as a copying machine or a laser beam printer, when one color image is formed, a controller analyzes information from an external apparatus, e.g., a computer, and executes image expansion (transform) to image information per yellow, magenta, cyan and black. Further, an engine controls a printing operation of successively forming toner images on a photosensitive drum based on the image information obtained with the image expansion by using toners of yellow, magenta, cyan and black, and further executing multi-transfer of the toner images onto an intermediate transfer member.

A method for reducing a first print-out time (hereinafter referred to as "FPOT") is proposed which executes the image expansion and the printing operation for each of the colors in parallel in the above-described type of image forming apparatus.

The term "FPOT" used in this specification implies a time from the start of operation of a printer until a first sheet is completely discharged onto a paper discharge tray. Also, the term "image expansion" implies a process of analyzing and expanding (transforming) a color image, which is to be printed, per color by the controller. Further, the term "printing operation" implies a process covering a step of forming a latent image per color on the photosensitive drum based on the image information that has been obtained by the controller executing the image expansion, a step of forming a toner image corresponding to each latent image, and a step of performing primary transfer of the toner image onto the intermediate transfer member.

However, when the above-described parallel processing method is employed and a long time is taken to execute the image expansion by the controller, there is a possibility that the image expansion is not completed until the timing at which the engine starts the printing operation. In that case, the engine cannot receive the image information and hence cannot execute the printing operation, thus resulting in a print error. To avoid such a print error, if the image expansion is not in time for the start of the printing operation, the controller transmits, to the engine, a signal for notifying the fact that the image expansion is not yet completed. Upon receiving the signal, the engine idly rotates a transfer drum once in a state where the printing operation is not executed, whereby the printing operation is postponed. A method capable of coping with the print error in such a manner is proposed in Japanese Patent Laid-Open No. 7-184019.

With the above-described related art, however, when the printing operation is postponed, at least a time corresponding to one rotation of the transfer drum is additionally required with the postponement of the printing operation. In other words, even when the image expansion is completed in the controller and the image information comes into a state capable of being transmitted immediately after the idle rotation of the transfer drum has been started to postpone the printing operation, the printing operation cannot be started until the transfer drum finishes one rotation. Thus, when the printing operation is postponed and the image expansion is completed in the controller during the idle rotation of the transfer drum, the time taken for the remaining idle rotation of the transfer drum becomes a loss time and the FPOT is prolonged.

SUMMARY OF THE INVENTION

In the view of the above-described state of the art, an exemplary embodiment of the present invention provides a technique for cutting the loss time caused when the printing operation is postponed, and for reducing the FPOT.

According to the exemplary embodiment of the present invention, a color image forming apparatus includes one image bearing member, an image forming unit configured to, based on image information corresponding to successively input images in plural different colors, successively form the images with toners in the plural different colors on the image bearing member per color, a revolving intermediate transfer member, and a transfer unit configured to successively transfer the images, which are successively formed on the image bearing member per color, onto the intermediate transfer member in a superimposed relation in a transfer section, the transfer unit keeping, at a constant speed, a revolving speed of the intermediate transfer member when the images are transferred, wherein a next image is transferred in a superimposed relation to a previous image having been previously transferred onto the intermediate transfer member, while the intermediate transfer member is continuously revolved at the constant speed, by executing control such that, when formation of the next image is not started at a due timing of starting the formation of the next image by the image forming unit, a timing at which transfer is started after the formation of the next image and a timing at which a leading end of the previous image having been previously transferred onto the intermediate transfer member reaches the transfer section are matched with each other by temporarily changing the revolving speed of the intermediate transfer member or by temporarily stopping the revolution of the intermediate transfer member.

Further features of the present invention will become apparent from the following description of exemplary embodiments with reference to the attached drawings.

DESCRIPTION OF THE EMBODIMENTS

Exemplary embodiments of the present invention will be described below with reference to the drawings. Be it noted that the following exemplary embodiments are not intended to restrict the scope of the present invention, which is defined in attached claims, and that combinations of features described in the following exemplary embodiments are not all essential to implement the present invention.

First Exemplary Embodiment

Figure 1:
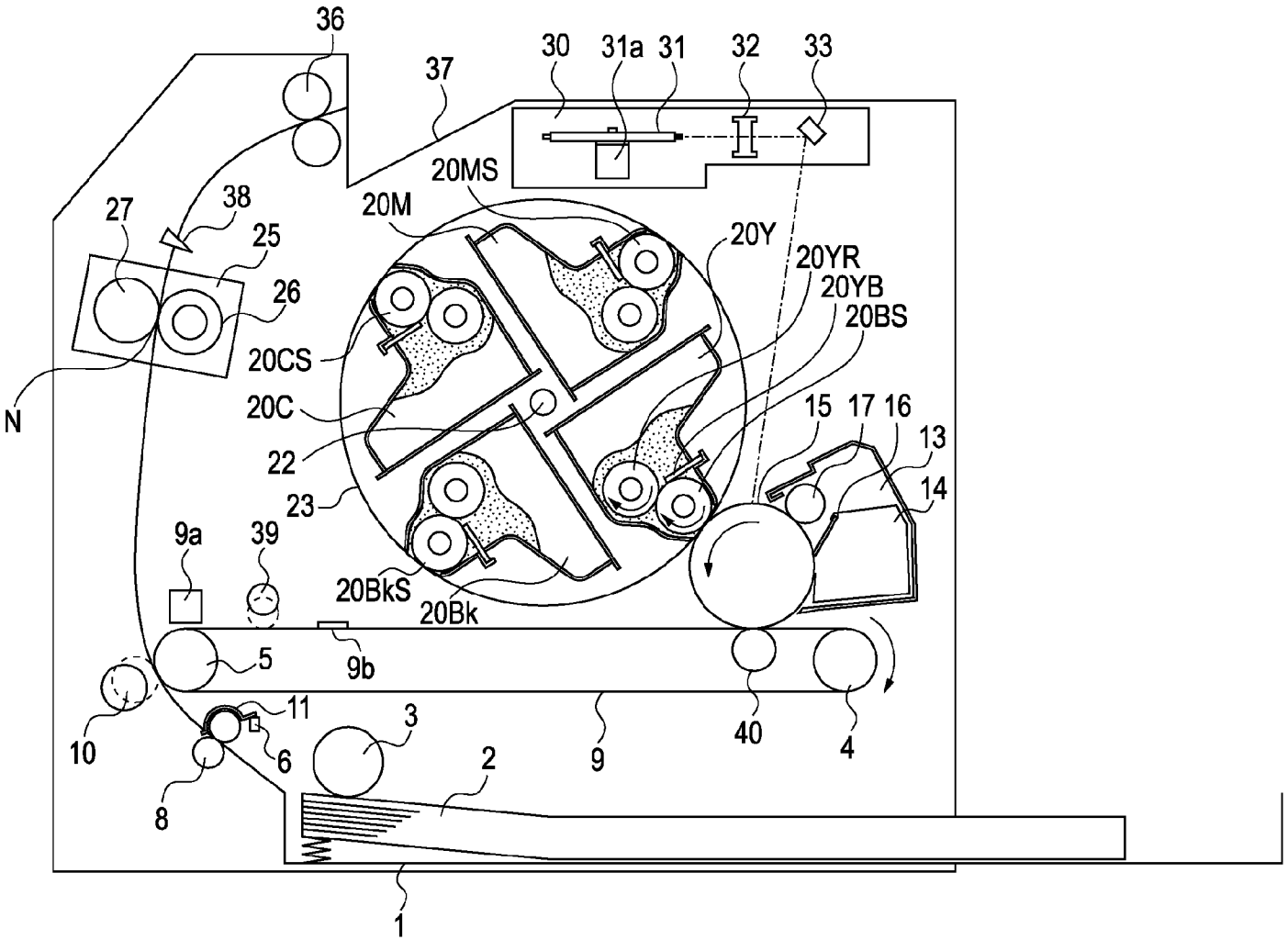
FIG. 1 is a schematic view illustrating an entire construction of a laser beam printer (color image forming apparatus) according to a first exemplary embodiment of the present invention.

FIG. 1 is a schematic view illustrating an example of an entire construction of a laser beam printer (color image forming apparatus) according to a first exemplary embodiment of the present invention. Detailed constructions of various components are first described in sequence of operations.

(Charging Section)

A drum unit 13 has an integral structure including an electrophotographic photosensitive member (hereinafter referred to as a "photosensitive drum") 15 which is a drum-shaped image bearing member, and a cleaning container 14 which is a cleaning apparatus serving also as a holder for the photosensitive drum 15. The drum unit 13 is detachably attached to a main body of the image forming apparatus such that the drum unit 13 is easily replaceable in agreement with the life of the photosensitive drum 15. Around the photosensitive drum 15, there are disposed a cleaner blade 16 and an electroconductive roller 17 which serves as a primary charging unit. The photosensitive drum 15 is rotated by a driving force (torque) of a driving roller (not shown) in the direction indicated by an arrow in accordance with the sequence of image forming processes.

The charging unit in this exemplary embodiment is of the contact charging type. More specifically, in a state of the electro-conductive roller 17 being brought into contact with the photosensitive drum 15, a voltage is applied to the electroconductive roller 17 such that the surface of the photosensitive drum 15 is uniformly charged.

(Exposure Section)

In a scanner unit 30 serving as an exposure section, exposure is performed to form a latent image on the photosensitive drum 15 which has been uniformly charged in the charging section. Upon receiving image information that is obtained from a controller (not shown) as a result of image expansion, a laser diode in the scanner unit 30 irradiates a laser beam corresponding to the obtained image information to a polygonal mirror 31. The polygonal mirror 31 is rotated at a high speed by a scanner motor 31*a* such that the laser beam reflecting from the polygonal mirror 31 selectively exposes the surface of the photosensitive drum 15, which is rotated at a constant speed, through a focusing lens 32 and a reflecting mirror 33.

(Developing Section)

In a developing section for forming a toner image on the photosensitive drum 15, the latent image formed on the photosensitive drum 15 in the exposure section is developed by using toners. The developing section includes a yellow developing unit 20Y, a magenta developing unit 20M, a cyan developing unit 20C, and a black developing unit 20Bk which contain respective toners as developers in four colors, i.e., yellow, magenta, cyan, and black.

Those developing units are each detachably held on a developing rotary 23 which is rotatable about a shaft 22. When respective toner images are formed, the developing units are intermittently rotated about the shaft 22 in a state where the developing units are held on the developing rotary 23. A developing roller of the developing unit containing the toner in color, which is used to develop the latent image, is stopped at a developing position at which the toner is to be applied to the photosensitive drum 15. Thereafter, the toner image is formed on the photosensitive drum 15.

In forming a color image, the developing rotary 23 is intermittently rotated for each revolution of an intermediate transfer member 9 such that the yellow developing unit 20Y, the magenta developing unit 20M, the cyan developing unit 20C, and the black developing unit 20Bk successively forms the respective toner images one color by one color in the order named. During four revolutions of the intermediate transfer member 9, the toner images in four colors, i.e., yellow, magenta, cyan, and black, are successively multi-transferred in a superimposed relation. As a result, a color image is formed on the intermediate transfer member 9.

FIG. 1 illustrates a state where the yellow developing unit 20Y is stopped at the developing position opposed to the drum unit 13. The yellow developing unit 20Y feeds the toner to an applying roller 20YR by a mechanism which is disposed in the yellow developing unit 20Y to deliver the toner in a container.

The toner is applied in the form of a thin layer onto an outer circumference of a developing roller 20YS, which is rotated in the direction indicated by an arrow, by the applying roller 20YR rotating in the direction indicated by an arrow and a blade 20YB held in pressure contact with an outer circumference of the developing roller 20YS. At the same time, electric charges are applied to the toner (due to frictional charging). By supplying a developing bias in the above-described state to the developing roller 20YS positioned to face the photosensitive drum 15 on which the latent image is formed, the latent image formed on the photosensitive drum 15 is developed.

Further, each of the magenta developing unit 20M, the cyan developing unit 20C, and the black developing unit 20Bk develops the latent image through a similar mechanism to that described above. A developing roller of each of the developing units is connected to a high-voltage power supply and to a driving source for the development per color, which are disposed in the main body of the image forming apparatus. When the developing units for the respective colors are each moved to the developing position, the corresponding developing rollers are successively supplied with a voltage and driven for rotation to develop the latent images in the respective colors.

(Primary Transfer Section)

To perform multi-transfer of the toner image formed on the photosensitive drum 15 in the developing section, the intermediate transfer member 9 is operated to revolve (run) in the direction indicated by an arrow in FIG. 1. While FIG. 1 illustrates the intermediate transfer member 9 as being in the form of a belt, the intermediate transfer member 9 is not limited to the belt and it may be, e.g., an intermediate transfer drum or a transfer material bearing member.

With four revolutions of the intermediate transfer member 9, the toner images in the respective colors are multi-transferred in the order of yellow, magenta, cyan, and black, thus forming a color image on the intermediate transfer member 9. In an area where the image is not formed on an outer peripheral surface of the intermediate transfer member 9, there are disposed a home position mark (hereinafter referred to as an "HP mark") 9*b*, i.e., a reference point which serves a reference for the timing of starting image formation per color, and an optical sensor 9*a* for detecting the HP mark 9*b*. The HP mark 9*b* can also be used to measure the peripheral length of the intermediate transfer member 9.

(Cleaning Section)

A cleaning section serves to clean the toner remaining on the photosensitive drum 15 after the toner image formed on the photosensitive drum 15 in the developing section has been transferred onto the intermediate transfer member 9. The waste toner removed by the cleaning is accumulated in the cleaning container 14.

(Paper Feed Section)

A paper feed section serves to feed a recording medium 2 and includes a cassette 1 containing plural sheets of recording media 2, a paper feed roller 3, and a registration roller pair 8. In the printing operation, the paper feed roller 3 is driven to rotate in a timed relation to the printing operation such that the recording media 2 in the cassette 1 are fed one by one to the registration roller pair 8.

A shutter 11 is disposed on the registration roller pair 8 to correct skewing of the recording medium 2 conveyed to the registration roller pair 8. A leading end sensor 6 is also disposed to detect the timing when the recording medium 2 reaches the shutter 11. The leading end sensor 6 detects a leading end of the recording medium 2, and the recording medium 2 is conveyed to a secondary transfer section by the registration roller pair 8 in match with the timing of the printing operation. As a result, registration between the image formed on the intermediate transfer member 9 and the recording medium 2 can be performed in secondary transfer as the next step.

(Secondary Transfer Section)

A secondary transfer section includes a secondary transfer roller 10 and a secondary transfer opposing roller 5. The secondary transfer roller 10 can be moved into a state contacting the intermediate transfer member 9 or a state away from the same, as indicated respectively by a broken line or a solid line in FIG. 1. During a period in which the toner images in the respective colors are multi-transferred onto the intermediate transfer member 9, the secondary transfer roller 10 is located at a lower position away from the intermediate transfer member 9, as indicated by the solid line, so that the toner images formed on the intermediate transfer member 9 are not disturbed. After the toner images in the respective colors have been multi-transferred onto the intermediate transfer member 9, the secondary transfer roller 10 is moved to an upper position, indicated by the broken line, by a cam member (not shown) in match with the timing of performing the secondary transfer of the image onto the recording medium 2. The recording medium 2 and the intermediate transfer member 9 are pressed under a predetermined pressure between the secondary transfer roller 10 having been moved to the upper position and the secondary transfer opposing roller 5. At that time, a bias is simultaneously supplied to the secondary transfer roller 10 for transferring the image on the intermediate transfer member 9 to the recording medium 2. The intermediate transfer member 9 and the secondary transfer roller 10 are driven to rotate in such a way that the recording medium 2 in the state held between the intermediate transfer member 9 and the secondary transfer roller 10 is subjected to the secondary transfer and is then conveyed to a fusing section 25, i.e., the next step to perform fusing of the image.

(Fusing Section)

The fusing section 25 includes a fusing roller 26 and a pressing roller 27 for cooperatively applying heat and pressure to fuse the image on the recording medium 2. The pressing roller 27 is pressed against the fusing roller 26 under a predetermined pressing force to form a fusing nip N with a predetermined width between both the rollers. The recording medium 2 is conveyed from the secondary transfer section to pass between the fusing roller 26 and the pressing roller 27 in a state where the surface of the recording medium 2 including the image is positioned to face the fusing roller 26. At that time, the fusing nip N is controlled to a predetermined temperature. Thus, the recording medium 2 conveyed to the fusing nip N is heated by the fusing roller 26 and is pressed by the pressing roller 27 so that the image is heated and fused for permanent fixation onto the recording medium 2.

Various sections of the image forming apparatus are constructed as described above. A series of operations for forming an image in the thus-constructed image forming apparatus will be described below.

First, the paper feed roller 3, illustrated in FIG. 1, is rotated to feed one sheet of the recording medium 2 from the cassette 1 to the registration roller pair 8. Then, the recording medium 2 waits at the registration roller pair 8 until the image is formed on the intermediate transfer member 9. On the other hand, in the process of forming the image, the surface of the photosensitive drum 15 is uniformly charged by the electroconductive roller 17, and a latent image of a yellow image is first formed with the operation of the scanner unit 30. At the same time as when the latent image is formed, the yellow developing unit 20Y is driven to develop the latent image by supplying a voltage, which has the same polarity as that of charges on the photosensitive drum 15 and a substantially equal potential to that of those charges, so that the yellow toner adheres to the latent image on the photosensitive drum 15.

In order to primary-transfer the toner image formed on the photosensitive drum 15 to the intermediate transfer member 9, a voltage having a characteristic reversal to that of the toner image formed on the photosensitive drum 15 is supplied to a primary transfer roller 40 from a power supply, thus performing the primary transfer of the toner image formed on the photosensitive drum 15 to the intermediate transfer member 9.

After the primary transfer of the yellow toner image onto the intermediate transfer member 9, the developing rotary 23 is rotated to angularly move the magenta developing unit 20M which is scheduled to perform the image formation as the next step, and the magenta developing unit 20M is stopped at the developing position at which the image formation is performed on the photosensitive drum 15. As with the yellow toner image, a magenta toner image is formed by developing a latent image that has been formed by charging and exposing the photosensitive drum 15. The magenta toner image formed on the photosensitive drum 15 is primary-transferred onto the intermediate transfer member 9 similarly to the yellow toner image. Further, the formation of the latent image, the development, and the primary transfer onto the intermediate transfer member 9 are successively performed for cyan and black. Thus, a color image is formed on the surface of the intermediate transfer member 9 as a result of multi-transfer of the toner images in four colors, i.e., yellow, magenta, cyan, and black.

After the color image has been formed on the intermediate transfer member 9, the recording medium 2 in a state waiting at the registration roller pair 8 is conveyed from there. The color image on the intermediate transfer member 9 is transferred to the recording medium 2 by pressing the recording medium 2 against the intermediate transfer member 9 between the secondary transfer roller 10 and the secondary transfer opposing roller 5, and by simultaneously supplying a bias, which has a characteristic reversal to that of the toners, to the secondary transfer roller 10.

After transferring the color image from the intermediate transfer member 9 to the recording medium 2, a charging roller 39 (hereinafter referred to as an "ICL roller") is brought into contact with the intermediate transfer member 9. The ICL roller 39 charges the toners remaining on the intermediate transfer member 9 to a polarity reversal to that of the toners charged in the developing step. After charging the remaining toners, the ICL roller 39 is moved away from the intermediate transfer member 9. When the image formation is performed in a successive manner, a yellow toner image for a next image is formed on the photosensitive drum 15 while the ICL roller 39 is brought into contact with the intermediate transfer member 9 to charge the remaining toners. At the timing when the formed yellow toner image is primary-transferred onto the intermediate transfer member 9 and it passes the position at which the ICL roller 39 is brought into contact with the intermediate transfer member 9, the ICL roller 39 is already moved away from the intermediate transfer member 9.

The remaining toners having been charged by the ICL roller 39 are electrostatically transferred to the photosensitive drum 15 in the primary transfer section where the photosensitive drum 15 and the intermediate transfer member 9 come into contact with each other, and are then recovered into the cleaning container 14 by the cleaning blade 16. Thus, the transfer of the remaining toners to the photosensitive drum 15 is performed at the same time as the primary transfer of the toner image in yellow, which is the first color for the next image, from the photosensitive drum 15 to the intermediate transfer member 9.

After the secondary transfer of the color image from the intermediate transfer member 9 to the recording medium 2, the secondary transfer roller 10 is moved away from the intermediate transfer member 9. When a next image (second page) is printed, a yellow toner image of the next image is formed on the photosensitive drum 15 while the recording medium 2 is conveyed to pass between the secondary transfer roller 10 and the intermediate transfer member 9 in a sandwiched state for the secondary transfer of the color image to the recording medium 2. After the yellow toner image has been formed on the photosensitive drum 15, but before a next magenta toner image starts to be formed, the secondary transfer roller 10 is moved from the position at which the secondary transfer roller 10 contacts the intermediate transfer member 9 to hold the recording medium 2 between them, to the position away from the intermediate transfer member 9. Thus, the recording medium 2 is peeled off from the intermediate transfer member 9 and is conveyed to the fusing section 25. After the color image is fused at the fusing nip N, the recording medium 2 is discharged onto a paper discharge tray 37, which is disposed on the upper side of the main body of the image forming apparatus, through a paper discharge roller 36 in such a state that the surface of the recording medium 2 including the color image is oriented to face downward. The series of image forming operations is thereby completed.

Figure 2:
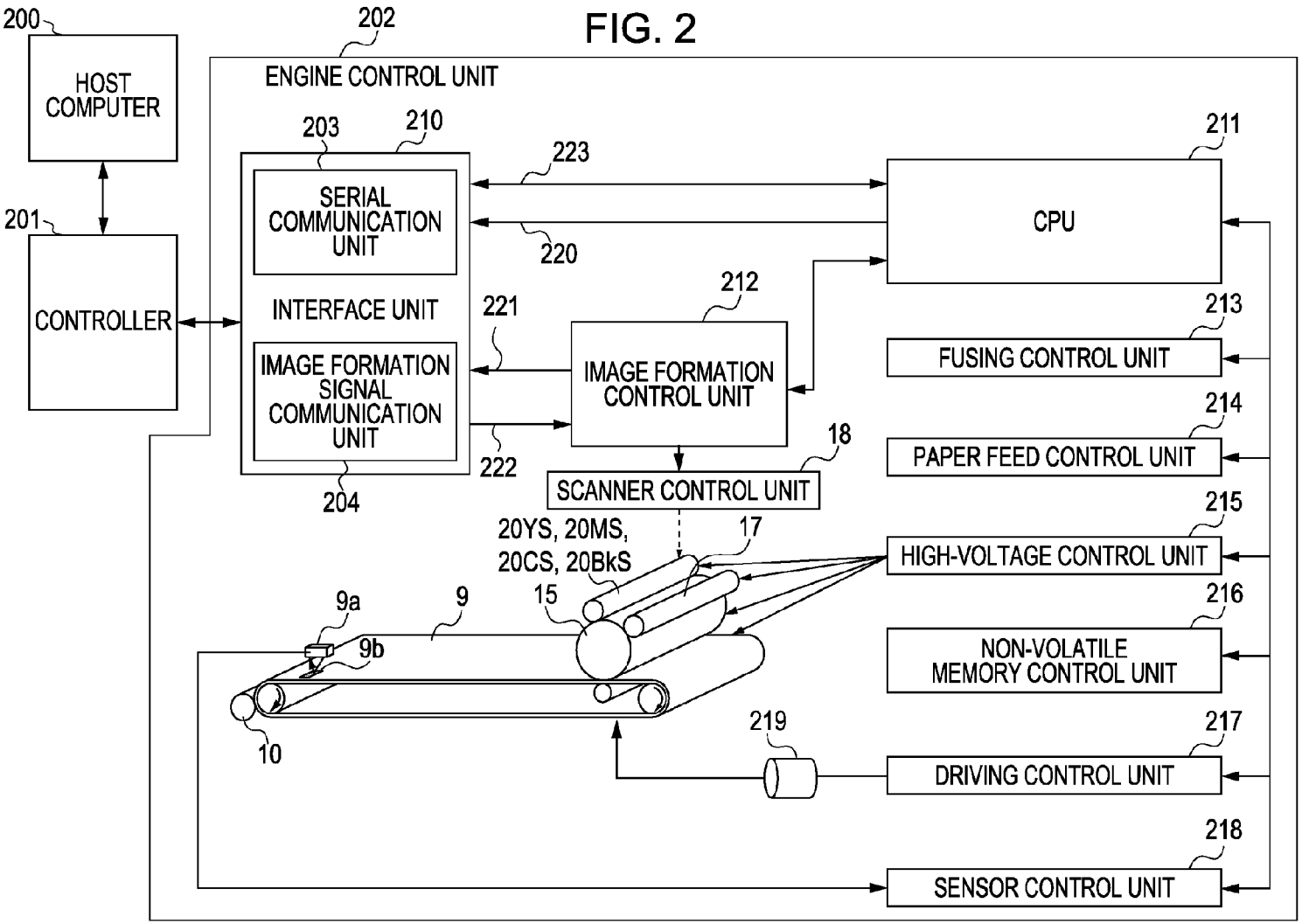
FIG. 2 is a block diagram illustrating a system configuration according to the first exemplary embodiment of the present invention.

FIG. 2 is a block diagram illustrating an example of a system configuration of the image forming apparatus. A host computer 200 transmits print data (including character code, figure data, image data, and process conditions), which are stated in the page description language such as PCL (Printer Control Language), to a controller 201.

The controller 201 receives the print data from the host computer 200. The controller 201 successively analyzes the received print data per color to generate image information in the form of a bit map of dot data, which is required to form an image by the printer (that process is referred to as "image expansion" hereinafter), and transmits the image information to an engine control unit 202. While this exemplary embodiment is described, for example, as executing the image expansion in the controller 201, the image expansion is not always required to be executed in the controller 201. As another example, the image expansion may be executed in the host computer 200, and resulting image information may be transmitted to the controller 201.

In order to form a color image based on the image information successively input from the controller 201, the engine control unit 202 controls the series of image forming operations including the formation of the latent image on the photosensitive drum 15, the formation of the toner image per color, the primary and secondary transfers, the fusing, and so on. The process from the formation of the latent image to the primary transfer (hereinafter referred to as the "printing operation") is executed in parallel to the image expansion.

An interface 210 interconnects the engine control unit 202 and the controller 201. The interface 210 includes a serial communication unit 203 and an image formation signal communication unit 204. The serial communication unit 203 receives commands and signals which are transmitted from the controller 201 to the engine control unit 202, and transmits a signal indicating the status of the image forming apparatus, a signal for requesting the image information, etc. to the controller 201 from the engine control unit 202. The image formation signal communication unit 204 receives the image information transmitted from the controller 201 to the engine control unit 202.

A CPU 211 controls the various control units and communication units in the engine control unit 202, and compares data transmitted to the controller 201 with data held in, e.g., a ROM (not shown) in the engine control unit 202. Also, the CPU 211 controls a sensor control unit 218 which in turn controls, e.g., the optical sensor 9*a* for detecting the HP mark 9*b* on the intermediate transfer member 9, and a driving control unit 217 which in turn controls, e.g., a main motor 219 for driving the intermediate transfer member 9, the photosensitive drum 15, and the developing rotary 23. Further, the CPU 211 controls generation of vertical sync signal (hereinafter referred to a "/TOP signal") 220 used to start the printing operation, and a horizontal sync signal 221 output from the scanner unit 30. In addition, the CPU 211 controls an image formation control unit 212 for executing control related to the printing operation, including the scanner motor and the laser output, a fusing control unit 213, a paper feed control unit 214, a high-voltage control unit 215, and a non-volatile memory control unit 216.

In the image forming apparatus according to this exemplary embodiment in which the color image is formed by intermittently rotating the developing rotary 23 for each revolution of the intermediate transfer member 9 to successively develop the latent images in the respective colors and by performing the multi-transfer of the toner images onto the intermediate transfer member 9, the primary transfer has to be started from the same position on the intermediate transfer member 9. The reason is that unless the primary transfer is started from the same position on the intermediate transfer member 9, the toner images in the respective colors are primary-transferred onto the intermediate transfer member 9 at positions shifted from one another and the color image cannot be properly formed.

To avoid such a problem, the HP mark 9*b* prepared on the outer peripheral surface of the intermediate transfer member 9 is detected by the optical sensor 9*a*. At the timing when the optical sensor 9*a* detects the HP mark 9*b*, the engine control unit 202 transmits the /TOP signal to the controller 201. Upon receiving the /TOP signal, the controller 201 transmits, to the engine control unit 202, the image information that has been generated with the image expansion. The engine control unit 202 can form the toner images in the respective colors based on the received image information and can perform the multi-transfer of the toner images in the respective colors to the same position on the intermediate transfer member 9.

More specifically, at the timing when the optical sensor 9*a* detects the HP mark 9*b*, the engine control unit 202 transmits the /TOP signal for the first color (yellow) to the controller 201. Upon receiving the /TOP signal, the controller 201 transmits the image information for yellow, generated with the image expansion, to the engine control unit 202. Upon receiving the image information, the engine control unit 202 forms a latent image on the photosensitive drum 15 based on the received image information, thus developing the latent image formed on the photosensitive drum 15 with the yellow toner. Further, the yellow toner image formed on the photosensitive drum 15 is primary-transferred to the intermediate transfer member 9.

Thus, since the printing operation is started based on detection of the HP mark 9*b* as a reference, a time from the timing of detecting the HP mark 9*b* and transmitting the /TOP signal to the start of the primary transfer of the toner image in each color can be held constant. Accordingly, the toner images in the respective colors can be multi-transferred to the same position on the intermediate transfer member 9. For each of the other three colors, i.e., magenta, cyan, and black, the toner image can be formed in the same manner as for yellow by transmitting the /TOP signal to the controller 201 at the timing when the optical sensor 9*a* detects the HP mark 9*b*. As a result, the toner images in the four colors are multi-transferred to the same position on the intermediate transfer member 9.

Figure 3:
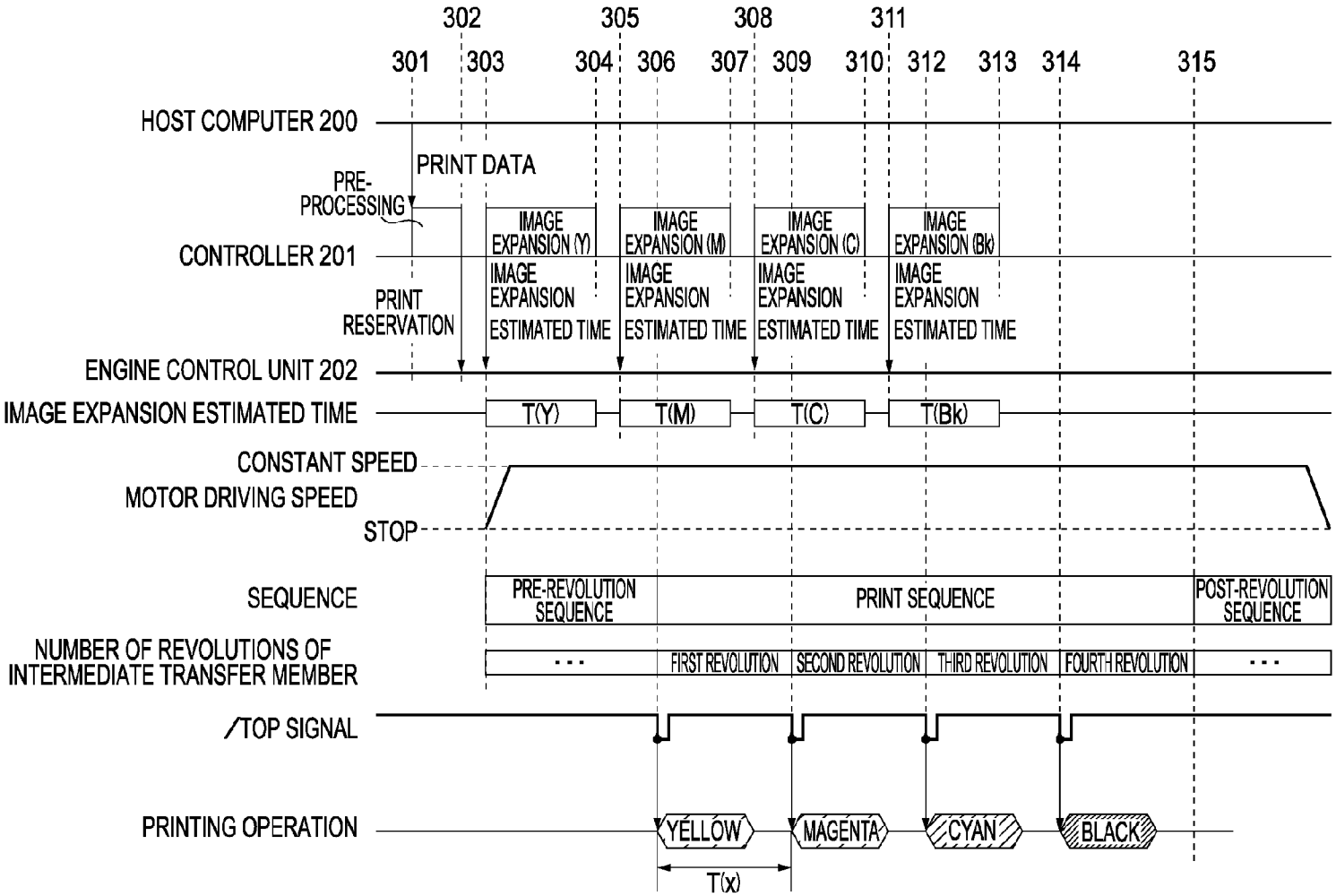
FIG. 3 is a timing chart illustrating an ordinary printing operation.
Figure 4:
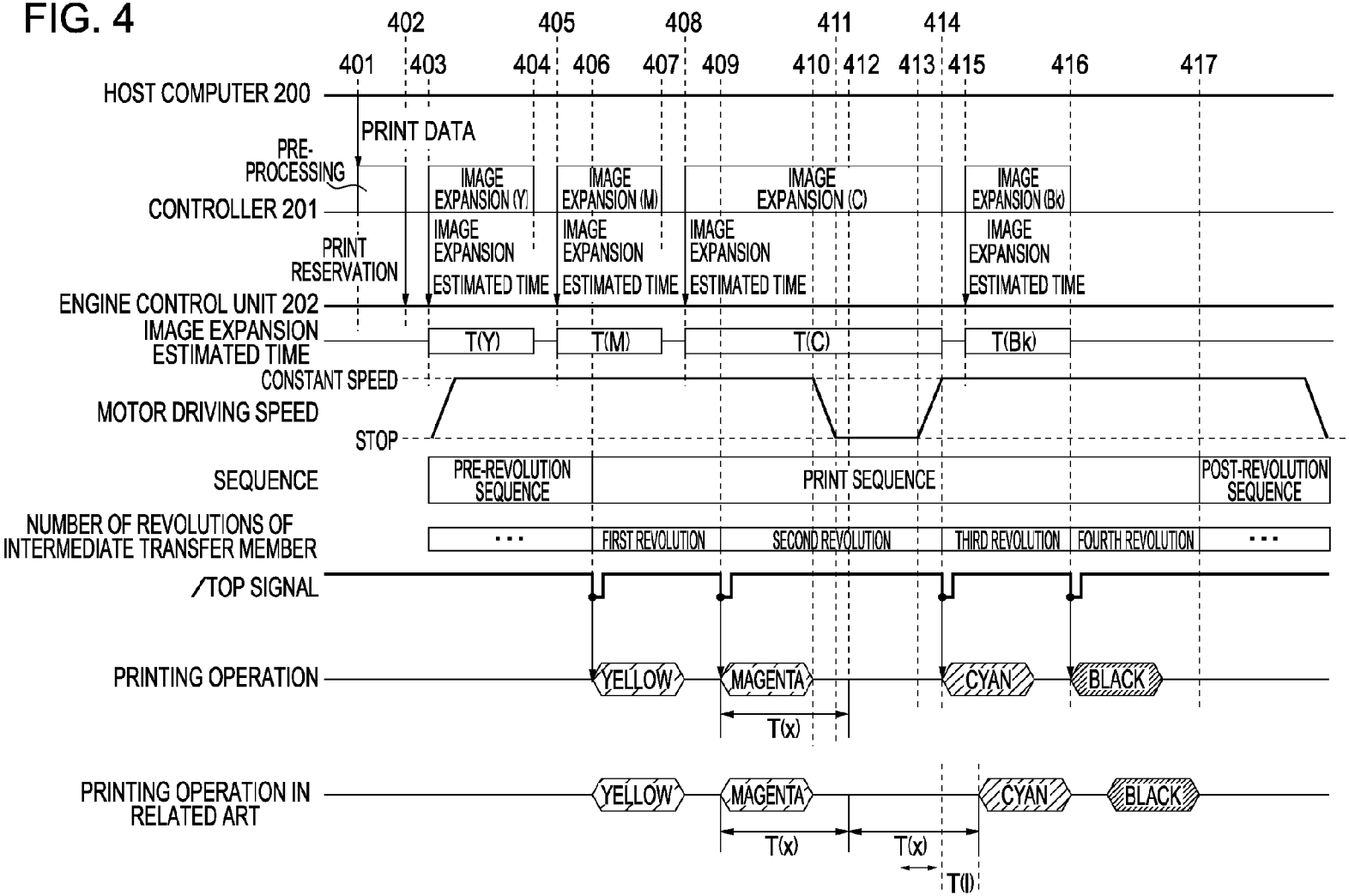
FIG. 4 is a timing chart when control is executed so as to stop an intermediate transfer member and to postpone image formation in the first exemplary embodiment.

FIGS. 3 and 4 are timing charts when the image expansion and the printing operation are executed in parallel processing in the first exemplary embodiment. Specifically, FIG. 3 is a timing chart illustrating an ordinary operation without postponing the printing operation, and FIG. 4 is a timing chart illustrating an example of processing executed when the printing operation is postponed because the image expansion is not completed in time for the start of the printing operation.

An example of the case of executing the ordinary operation without postponing the printing operation is described with reference to the timing chart of FIG. 3. The controller 201 receives the print data from the host computer 200 (at a time 301). Upon receiving the print data, the controller 201 analyzes the print data into data used to execute the image expansion and a print instruction (including the size and the type of a sheet, process conditions, etc.) as pre-processing, and then transmits the print instruction, as a print reservation command, to the engine control unit 202 (at a time 302).

At this time, the controller 201 estimates a time required to execute the image expansion per color from the data used in the image expansion. The estimated time is transmitted, as an image expansion estimated time, to the engine control unit 202 prior to the start of the image expansion per color. While this exemplary embodiment is described, for example, as estimating the time required to execute the image expansion per color in a successive manner for the four colors, the time estimation is not always required to be executed in the successive manner and may be executed in a separate manner when the image expansion is performed per color.

Next, the controller 201 starts the image expansion per color based on the data that is contained in the print data and that is used for the image expansion. In this exemplary embodiment, the image expansion for yellow is first started. At the time of starting the image expansion, the controller 201 transmits the image expansion estimated time, which is obtained by estimating the processing time taken to execute the image expansion for yellow, to the engine control unit 202 (at a time 303). Upon receiving the image expansion estimated time, the engine control unit 202 starts pre-processing required to execute the image formation (hereinafter referred to as a "pre-revolution sequence"). Simultaneously, the engine control unit 202 compares the time required to execute the image expansion for yellow and the time required for the pre-revolution sequence with each other (303).

The term "pre-revolution sequence" implies preliminary preparations to execute the image formation, which include preset processes such as rotating the photosensitive drum 15 for a predetermined time to stabilize the surface potential, and starting up various actuators necessary for the image formation. The engine control unit 202 previously holds the time required for the pre-revolution sequence in the form of data in, e.g., the ROM (not shown).

As illustrated in the timing chart of FIG. 3, when the processing for the pre-revolution sequence is completed at a time later than the completion of the image expansion for yellow, the engine control unit 202 starts the pre-revolution sequence as soon as it receives the image expansion estimated time. On the other hand, when the processing for the pre-revolution sequence is completed, though not illustrated, at a time earlier than the completion of the image expansion for yellow, the following problem occurs. If the engine control unit 202 starts the pre-revolution sequence at once, the image expansion for yellow is not yet completed at the time when the pre-revolution sequence is completed and the /TOP signal is transmitted, and hence the image information cannot be received. In such a case, therefore, the start of the pre-revolution sequence is delayed to be matched with the end time of the image expansion for yellow such that both the processes are completed at the same timing. Note that, in the drawings described below, the four colors used in forming the color image, i.e., yellow, magenta, cyan, and black, are denoted by (Y), (M), (C) and (Bk), respectively.

After the completion of the image expansion for yellow (at a time 304), the controller 201 starts the image expansion for magenta and transmits the image expansion estimated time for magenta to the engine control unit 202 (at a time 305). Upon receiving the image expansion estimated time for magenta, the engine control unit 202 compares a "time of end of the image expansion for magenta" with "a time of end of the pre-revolution sequence+a time T(x) from transmission of the /TOP signal issued in the first revolution of the intermediate transfer member 9 to transmission of the /TOP signal issued in the second revolution thereof". If the time of end of the image expansion for magenta is later, the printing operation is postponed. If the time of end of the image expansion for magenta is earlier, the printing operation is not postponed and the ordinary printing operation is executed. In the timing chart of FIG. 3, because the time of end of the image expansion for magenta is earlier, the printing operation is not postponed. The time T(x) represents a time required to revolve the intermediate transfer member 9 once at a constant speed without postponing the printing operation, and it is the same for each color. In other words, a time taken to execute the image formation for the four colors without postponing the printing operation is 4T(x). The term "constant speed" implies a speed of the intermediate transfer member 9 when the primary transfer of the toner image in the first color is performed. The multi-transfer free from color misregistration can be performed by transferring the toner images in the second and subsequent colors at the same speed of the intermediate transfer member 9 as that in the primary transfer for the first color.

When the HP mark 9*b* on the intermediate transfer member 9 is detected after the end of the pre-revolution sequence, the engine control unit 202 transmits the /TOP signal to the controller 201 and receives the image information for yellow from the controller 201 to start the printing operation (at a time 306). When the image expansion for magenta is completed (at a time 307), the controller 201 starts the image expansion for cyan and transmits the image expansion estimated time for cyan to the engine control unit 202 (at a time 308).

Upon receiving the image expansion estimated time for cyan, the engine control unit 202 compares a "time of end of the image expansion for cyan" with a "time of transmission of the /TOP signal issued in the third revolution". As in the above-described processing for magenta, if the time of end of the image expansion for cyan is later, the printing operation is postponed. If the time of end of the image expansion for cyan is earlier, the printing operation is not postponed and the ordinary printing operation is executed. In the timing chart of FIG. 3, because the time of end of the image expansion for cyan is earlier, the printing operation is not postponed.

When the HP mark 9*b* on the intermediate transfer member 9 is detected after the end of the printing operation for yellow, the engine control unit 202 transmits the /TOP signal to the controller 201 and receives the image information for magenta from the controller 201 to start the printing operation (at a time 309). When the image expansion for cyan is completed (at a time 310), the controller 201 starts the image expansion for black and transmits the image expansion estimated time for black to the engine control unit 202 (at a time 311).

Upon receiving the image expansion estimated time for black, the engine control unit 202 compares a "time of end of the image expansion for black" with a "time of transmission of the /TOP signal issued in the fourth revolution". As in the above-described processing for cyan, if the time of end of the image expansion for black is later, the printing operation is postponed. If the time of end of the image expansion for black is earlier, the printing operation is not postponed and the ordinary printing operation is executed. In the timing chart of FIG. 3, because the time of end of the image expansion for black is earlier, the printing operation is not postponed.

When the HP mark 9*b* on the intermediate transfer member 9 is detected after the end of the printing operation for magenta, the engine control unit 202 transmits the /TOP signal to the controller 201 and receives the image information for cyan from the controller 201 to start the printing operation (at a time 312). In parallel, the controller 201 completes the image expansion for black (at a time 313). When the HP mark 9*b* on the intermediate transfer member 9 is detected after the end of the printing operation for cyan, the engine control unit 202 transmits the /TOP signal to the controller 201 and receives the image information for black from the controller 201 to start the printing operation (at a time 314).

If the next print reservation command is not yet received at the time of completion of the printing operations for all the colors, the engine control unit 202 executes the processing subsequent to the primary transfer (hereinafter referred to as a "post-revolution sequence") (at a time 315), whereby the printing operation is brought to an end. Concretely, the term "post-revolution sequence" implies such processes as performing secondary transfer of the image, which has been primary-transferred onto the intermediate transfer member 9, to the recording medium 2, fusing the secondary-transferred image on the recording medium 2, discharging paper (i.e., the recording medium 2), and cleaning the intermediate transfer member 9.

In this exemplary embodiment, as described above, the image expansion estimated time is transmitted from the controller 201 to the engine control unit 202, and the engine control unit 202 determines whether the printing operation is to be postponed. Alternatively, the control process may be modified, for example, such that the controller 201 obtains the time of the start of the printing operation from the engine control unit 202, determines whether the printing operation is to be postponed, and transmits an instruction to the engine control unit 202. That modification can be similarly applied to all the exemplary embodiments described below.

Thus, by executing the image expansion and the printing operation for each color in parallel, the FPOT can be cut in comparison with the processing method of starting the printing operation after the image expansions for all the colors are completed.

An example of the case of postponing the printing operation without idly revolving the intermediate transfer member 9 when the image expansion process for some color is not completed in time for the start of the printing operation will be described below with reference to the timing chart of FIG. 4. The term "idle revolution" implies that the intermediate transfer member 9 is revolved once without performing the printing operation.

Processes from 401 to 407 are the same as those from 301 to 307 described above with reference to FIG. 3, and hence a description thereof is omitted. A process of postponing the printing operation is described below.

When the image expansion for magenta is completed (at a time 407), the controller 201 starts the image expansion for cyan and transmits the image expansion estimated time for cyan to the engine control unit 202 (at a time 408). Upon receiving the image expansion estimated time for cyan, the engine control unit 202 compares a "time of end of the image expansion for cyan" with a "time (412) of transmission of the /TOP signal issued in the third revolution". In the illustrated example, the image expansion for cyan is not yet completed at the time of transmission of the /TOP signal issued in the third revolution. Stated another way, even at the due timing of performing the primary-transfer of the cyan toner image onto the intermediate transfer member 9, the development of the cyan toner image onto the photosensitive drum 15 cannot be started. Accordingly, the printing operation is postponed.

Concretely, the printing operation is postponed as follows. After the printing operation for magenta is started (409) and is completed (410), the revolving speed of the intermediate transfer member 9 is temporarily changed and then stopped (411). After stopping the driving of the intermediate transfer member 9, the engine control unit 202 compares a "remaining time until the end of the image expansion for cyan" with a "time required for the intermediate transfer member 9 to reach the constant speed after resumption of the driving thereof". When the "remaining time until the end of the image expansion for cyan" becomes equal to or shorter than the "time required for the intermediate transfer member 9 to reach the constant speed after resumption of the driving thereof", the engine control unit 202 resumes the driving of the intermediate transfer member 9 (at a time 413).

When the HP mark 9*b* on the intermediate transfer member 9 is detected after the driving of the intermediate transfer member 9 has been resumed and returned to the constant speed, the engine control unit 202 transmits the /TOP signal to the controller 201 and receives the image information for cyan from the controller 201 to start the printing operation (at a time 414). Subsequent processes from 415 to 417 are the same as those from 311 to 315 described above with reference to FIG. 3, and hence a description thereof is omitted.

A row at the bottom of the timing chart of FIG. 4 represents the case where the printing operation is postponed according to the related art. When the printing operation is postponed according to the related-art method under the same conditions as those in this exemplary embodiment, the intermediate transfer member 9 is caused to idly revolve once at the constant speed, as illustrated in the chart, after the end of the printing operation for magenta. Thus, the time T(x) required for the intermediate transfer member 9 to revolve once becomes the loss time. On the other hand, in this exemplary embodiment, the printing operation for cyan is started earlier than in the related art by a time T(1), as seen from the chart. According to this exemplary embodiment, therefore, the loss time can be cut by the time T(1) in comparison with the related art.

A description is now made for exceptional processes which can be executed when the printing operation is postponed. As seen from FIG. 4 and the above description, the timing of end of the image expansion and the timing of end of the postponed printing operation can be made matched with each other by properly postponing the printing operation. Stated another way, because the time of end of the image expansion is confirmed based on the image expansion estimated time, the control can be executed such that the loss time is minimized. It may, however, sometimes happen that the image expansion is not completed as per the image expansion estimated time due to, e.g., any trouble generated in the controller 201 or a reduction in the processing speed of the image expansion.

In view of such an event, for example, the controller 201 may transmit the image expansion estimated time to the engine control unit 202 after adding a predetermined time, i.e., a margin to accommodate for an accidental situation, to the image expansion estimated time. As another example, if the image information cannot be received even at the time when the /TOP signal is transmitted to the controller 201, the engine control unit 202 may stop the intermediate transfer member 9 and then request the controller 201 to transmit the image expansion estimated time again.

As still another example, if the image information cannot be received even at the time when the /TOP signal is transmitted to the controller 201, the engine control unit 202 may idly revolve the intermediate transfer member 9 and then request the controller 201 to transmit the image expansion estimated time again. As still another example, if the image information cannot be received even at the time when the /TOP signal is transmitted to the controller 201, the engine control unit 202 may stop the printing operation and then transmit an error signal to the controller 201. While the above description with reference to FIG. 4 is made as postponing only the printing operation for cyan, it may also happen that the image expansion is delayed beyond the start of the printing operation for plural colors. In such a case, this exemplary embodiment of the present invention can be applied to the process of postponing the printing operation for each of the plural colors.

Figure 7:
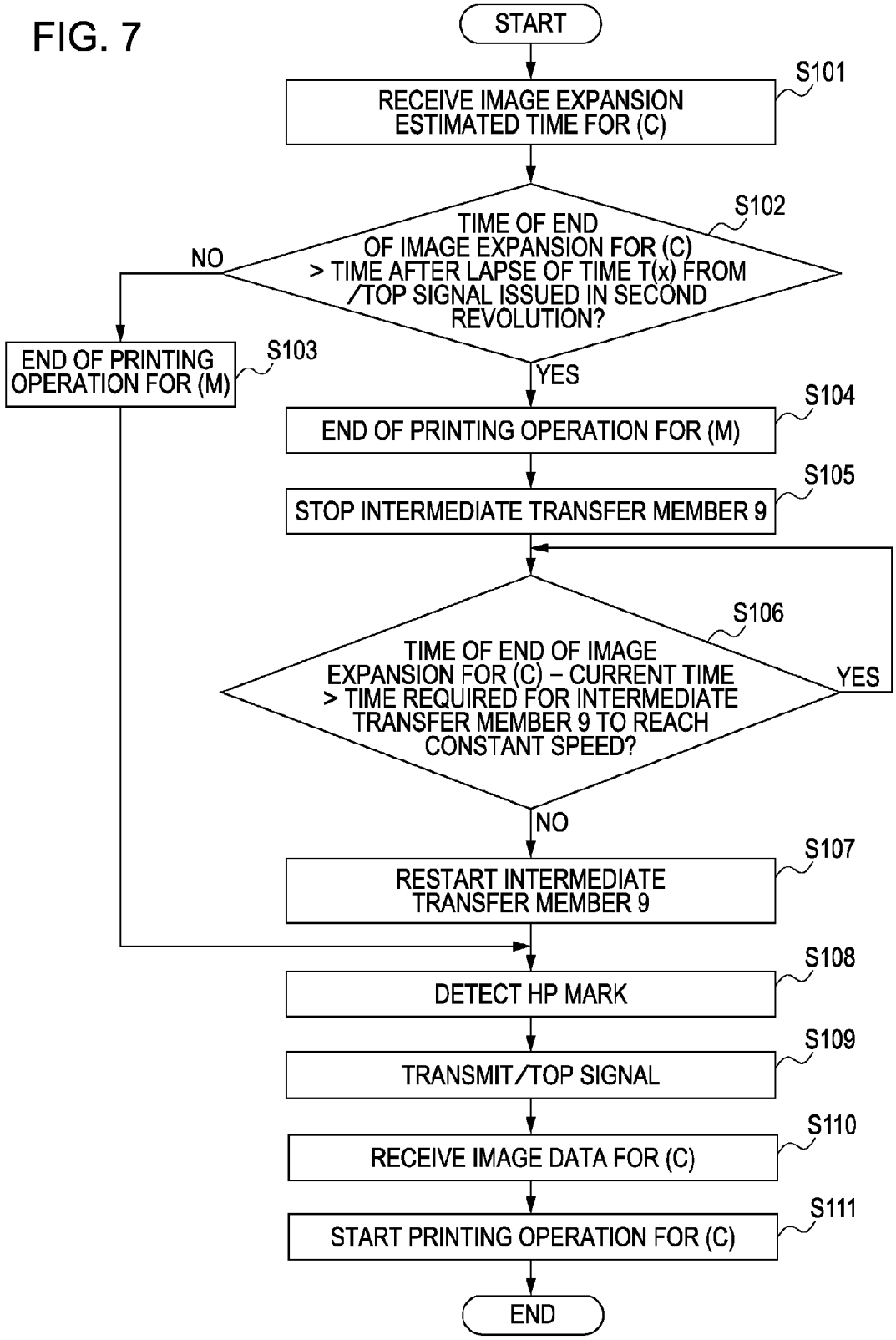
FIG. 7 is a flowchart when the printing operation is postponed by stopping the intermediate transfer member in the first exemplary embodiment.

The process for realizing the operation in this exemplary embodiment will be described below with reference to a flowchart of FIG. 7. The flowchart of FIG. 7 is intended to explain only the process of postponing the printing operation in more detail by extracting the corresponding part from the above description which has been made with reference to FIG. 4.

The engine control unit 202 receives the image expansion estimated time for cyan from the controller 201 (S101). Upon receiving the image expansion estimated time for cyan, the engine control unit 202 compares the time of end of the image expansion for cyan with the time of transmission of the /TOP signal issued in the third revolution after the lapse of the time T(x) from the /TOP signal issued in the second revolution (S102). If the comparison result in S102 indicates that the time of end of the image expansion for cyan is earlier, the next printing operation for cyan is started after executing the printing operation for magenta in an ordinary manner (S103).

If the comparison result in S102 indicates that the time of transmission of the /TOP signal issued in the third revolution is earlier, the printing operation for cyan is postponed. More specifically, after the end of the printing operation for magenta (S104), the driving of the intermediate transfer member 9 is stopped (S105). In this exemplary embodiment, the driving of the intermediate transfer member 9 is controlled, for example, by controlling a DC motor. However, the method of controlling the driving of the intermediate transfer member 9 is not limited to the use of the DC motor. As another example, a pulse motor can also be used and a time taken to stop the motor can be shortened by using the pulse motor. The control of the intermediate transfer member 9 can be properly executed regardless of the types of motors by recording, in a RAM (not shown), for example, changes in the control time depending on the motors. Hence, any desired type of motor is usable.

After stopping the driving of the intermediate transfer member 9, the engine control unit 202 compares the remaining time until the end of the image expansion for cyan with the time required for the intermediate transfer member 9 to reach the constant speed from the stopped state (S106). If the remaining time until the end of the image expansion for cyan is equal to or shorter than the time required for the intermediate transfer member 9 to reach the constant speed from the stopped state, the driving of the intermediate transfer member 9 is resumed and the intermediate transfer member 9 is revolved at the constant speed to execute the printing operation (S107).

The reason why the comparison in S106 is performed resides in that a certain time is taken to accelerate the intermediate transfer member 9 from the stopped state to the constant speed again at which the primary transfer can be performed. The engine control unit 202 previously holds, in the ROM (not shown), for example, the time taken to accelerate the intermediate transfer member 9 from the stopped state to the constant speed. Accordingly, the loss time caused by postponing the printing operation can be reduced by comparing the time required for the intermediate transfer member 9 to reach the constant speed and the remaining time until the end of the image expansion for cyan with each other.

When the HP mark 9*b* on the intermediate transfer member 9 is detected (S108) after resuming the driving of the intermediate transfer member 9, the engine control unit 202 transmits the /TOP signal to the controller 201 (S109). Upon receiving the /TOP signal, the controller 201 transmits the image information for cyan to the engine control unit 202 (S110). Upon receiving the image information for cyan, the engine control unit 202 starts the printing operation for cyan (S111).

As described above with reference to the timing chart of FIG. 4 and the flowchart of FIG. 7, when the image expansion for the next color is not completed during the printing operation for the previous color, the printing operation can be postponed by stopping the driving of the intermediate transfer member 9. On that occasion, the loss time caused by postponing the printing operation can be reduced by the engine control unit 202 which sets the time of resuming the driving of the intermediate transfer member 9 based on the relevant image expansion estimated time, i.e., the image expansion estimated time received from the controller 201. In other words, the printing operation can be postponed per color depending on the time required for the image expansion per color without idly revolving the intermediate transfer member 9. As a result, prolongation of the FPOT can be suppressed minimum.

While the image expansion estimated time and the timing of transmission of the /TOP signal are used in this exemplary embodiment as criteria for determining whether the printing operation is to be postponed, the criteria for determining whether the printing operation is to be postponed are not limited to them. For example, it may sometimes happen that, in spite of the image expansion being completed as per the image expansion estimated time, the development of the toner image onto the photosensitive drum 15 cannot be started even at the due timing of performing the primary transfer onto the intermediate transfer member 9 because a longer time than usual is taken for the communication. In that case, confirmation as to whether the image information has been received can be set as another criterion for determining whether the printing operation is to be postponed. While that case requires, as an additional parameter, a time taken from the reception of the image information to the start of the development, such a time is previously held in the engine control unit 202. Thus, the printing operation can be postponed and the similar advantage can be obtained as in the case using the image expansion estimated time.

Second Exemplary Embodiment

A second exemplary embodiment can be practiced in the same configurations as those, illustrated in FIGS. 1 and 2, which have been described above in connection with the first exemplary embodiment, and hence a detailed description of the configurations is omitted. The second exemplary embodiment is intended to postpone the printing operation without idly revolving the intermediate transfer member 9 as in the first exemplary embodiment. However, the second exemplary embodiment differs from the first exemplary embodiment in that the printing operation is postponed by decelerating the driving speed of the intermediate transfer member 9 instead of stopping the intermediate transfer member 9.

Figure 5:
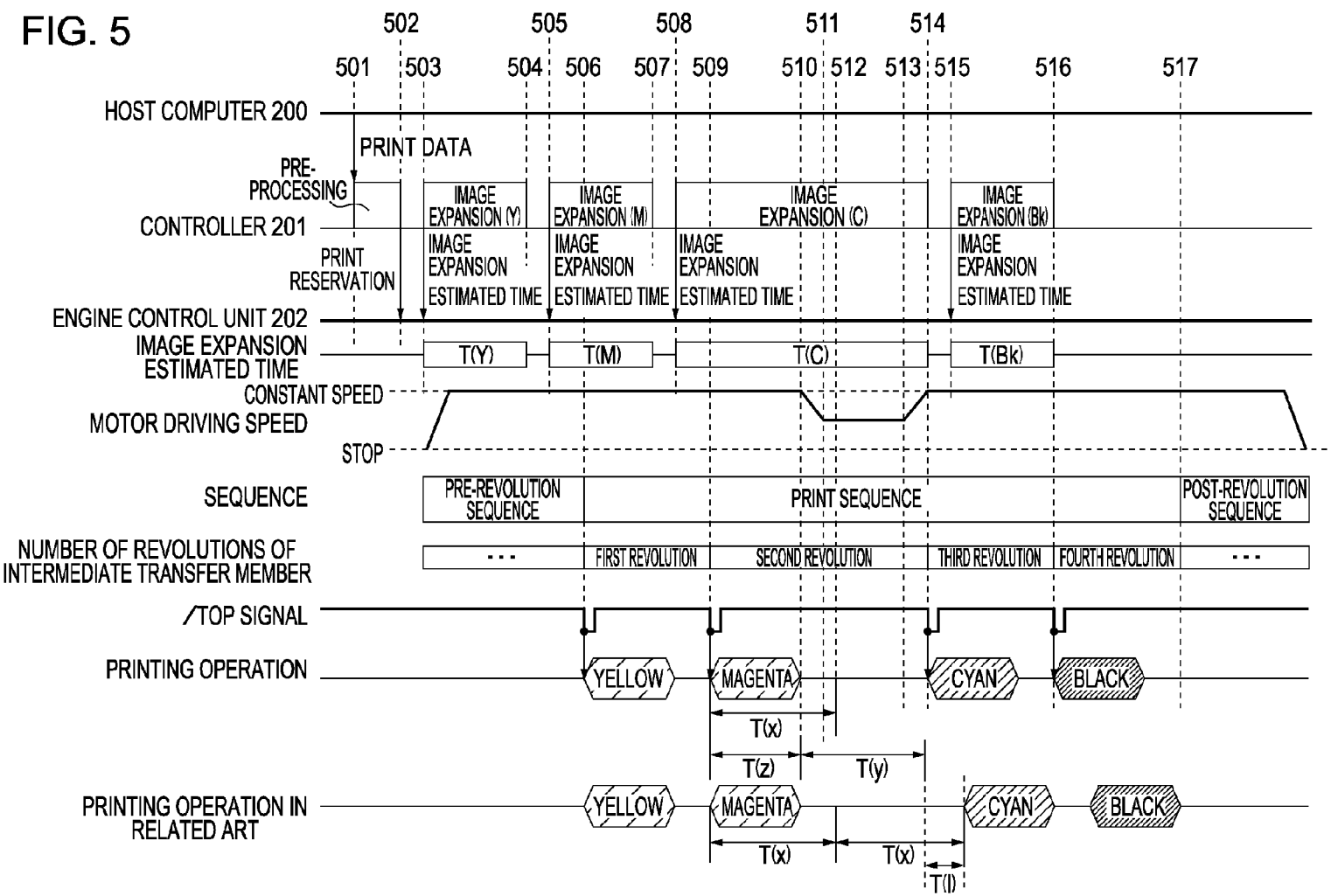
FIG. 5 is a timing chart when control is executed so as to postpone the image formation in a second exemplary embodiment by decelerating the intermediate transfer member without idly revolving it.

FIG. 5 is a timing chart when the printing operation is postponed by decelerating the intermediate transfer member 9 without idly revolving it, and then returning the intermediate transfer member 9 to the constant speed. Processes from 501 to 507 are the same as those from 301 to 307 described above with reference to FIG. 3 illustrating the first exemplary embodiment, and hence a description thereof is omitted. A process of postponing the printing operation is described below.

When the image expansion for magenta is completed (at a time 507), the controller 201 starts the image expansion for cyan and transmits the image expansion estimated time for cyan to the engine control unit 202 (at a time 508). Upon receiving the image expansion estimated time for cyan, the engine control unit 202 compares a "time of end of the image expansion for cyan" with a "time (512) of transmission of the /TOP signal issued in the third revolution". In the illustrated example, the image expansion for cyan is not yet completed at the time of transmission of the /TOP signal issued in the third revolution. Accordingly, the printing operation is postponed.

When the printing operation is postponed, whether the intermediate transfer member 9 is to be idly revolved is first determined. It is here assumed that T(z) represents a time taken to perform the primary transfer onto the intermediate transfer member 9 as the printing operation for magenta, and T(y) represents a time (from 510 to 514) that can be postponed by decelerating the intermediate transfer member 9 during a period from the end of the printing operation for magenta to the time of transmission of the /TOP signal issued in the third revolution. The time T(z) is defined depending on the size of an image subjected to the primary transfer, and the time T(y) is defined depending on both the length of the intermediate transfer member 9 from the tailing end of the image after the primary transfer to the HP mark 9*b* and the speed of the intermediate transfer member 9.

In other words, if the image expansion for cyan is completed not later than "the time of transmission of the /TOP signal issued in the second revolution+T(z)+T(y)", the printing operation can be postponed without idly revolving the intermediate transfer member 9. In the example of FIG. 5, since it is confirmed that the image expansion for cyan can be completed not later than the above-mentioned time, the intermediate transfer member 9 is not idly revolved.

After the printing operation for magenta is started (509) and is completed (510), the intermediate transfer member 9 is decelerated (511). After decelerating the intermediate transfer member 9, the engine control unit 202 compares a "remaining time until the end of the image expansion for cyan" with a "time required for the intermediate transfer member 9 to reach the constant speed with acceleration". When the "remaining time until the end of the image expansion for cyan" becomes equal to or shorter than the "time required for the intermediate transfer member 9 to reach the constant speed with acceleration", the engine control unit 202 accelerates the intermediate transfer member 9 (at a time 513).

When the HP mark 9*b* on the intermediate transfer member 9 is detected after the intermediate transfer member 9 has been accelerated and returned to the constant speed, the engine control unit 202 transmits the /TOP signal to the controller 201 and receives the image information for cyan from the controller 201 to start the printing operation (at a time 514). Subsequent processes from 515 to 517 are the same as those from 311 to 315 described above with reference to FIG. 3, and hence a description thereof is omitted.

A row at the bottom of the timing chart of FIG. 5 represents the case where the printing operation is postponed according to the related art. When the printing operation is postponed according to the related-art method under the same conditions as those in this second exemplary embodiment, the intermediate transfer member 9 is caused to idly revolve once at the constant speed, as illustrated in the chart, after the end of the printing operation for magenta. Thus, the time T(x) required for the intermediate transfer member 9 to revolve once becomes the loss time. On the other hand, in this second exemplary embodiment, the printing operation for cyan is started earlier than in the related art by a time T(1), as seen from the chart. According to this second exemplary embodiment, therefore, the loss time can be cut by the time T(1) in comparison with the related art. Note that the exceptional processes described above in connection with the first exemplary embodiment can be similarly applied to the case where the printing operation is postponed through the control according to the timing chart illustrated in FIG. 5.

Figure 8:
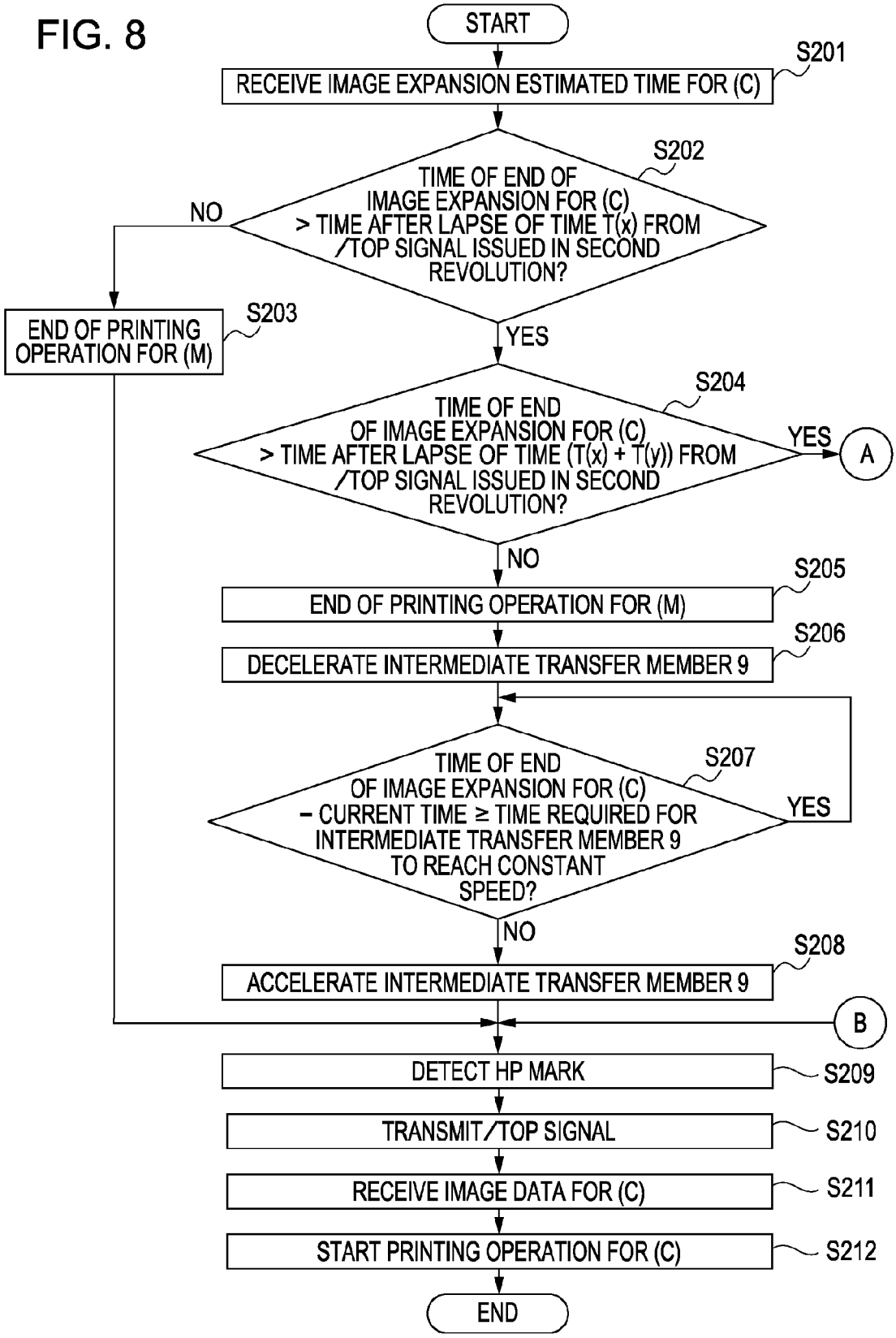
FIG. 8 is a flowchart when the printing operation is postponed by decelerating the intermediate transfer member in the second exemplary embodiment.

FIG. 8 is a flowchart when the printing operation is postponed by decelerating the intermediate transfer member 9 without idly revolving the same. The flowchart of FIG. 8 is intended to explain only the process of postponing the printing operation in more detail by extracting the corresponding part from the above description which has been made with reference to FIG. 5.

The engine control unit 202 receives the image expansion estimated time for cyan from the controller 201 (S201). Upon receiving the image expansion estimated time for cyan, the engine control unit 202 compares the time of end of the image expansion for cyan with the time of transmission of the /TOP signal issued in the third revolution after the lapse of the time T(x) from the /TOP signal issued in the second revolution (S202).

If the comparison result in S202 indicates that the time of end of the image expansion for cyan is earlier, the next printing operation for cyan is started after executing the printing operation for magenta in an ordinary manner (S203). If the comparison result in S202 indicates that the time of transmission of the /TOP signal issued in the third revolution is earlier, the engine control unit 202 compares the time of end of the image expansion for cyan with the time of transmission of the /TOP signal issued in the third revolution after the lapse of the time (T(z)+T(y)) from the /TOP signal issued in the second revolution (S204).

If the comparison result in S204 indicates that the time of end of the image expansion for cyan is earlier, the printing operation for cyan is postponed without idly revolving the intermediate transfer member 9. More specifically, after the end of the printing operation for magenta (S205), the intermediate transfer member 9 is decelerated (S206).

After decelerating the intermediate transfer member 9, the engine control unit 202 compares the remaining time until the end of the image expansion for cyan with the time required for the intermediate transfer member 9 to reach the constant speed from the decelerated state (S207). If the remaining time until the end of the image expansion for cyan is equal to or shorter than the time required for the intermediate transfer member 9 to reach the constant speed from the decelerated state, the intermediate transfer member 9 is accelerated for return to the constant speed to execute the printing operation (S208).

The reason why the comparison in S207 is performed resides in that a certain time is taken to accelerate the intermediate transfer member 9 from the decelerated state to the constant speed again at which the primary transfer can be performed. The engine control unit 202 previously holds the time taken to accelerate the intermediate transfer member 9 from the decelerated state to the constant speed. Accordingly, the loss time caused by postponing the printing operation can be reduced by comparing the time required for the intermediate transfer member 9 to reach the constant speed and the remaining time until the end of the image expansion for cyan with each other.

Figure 9:
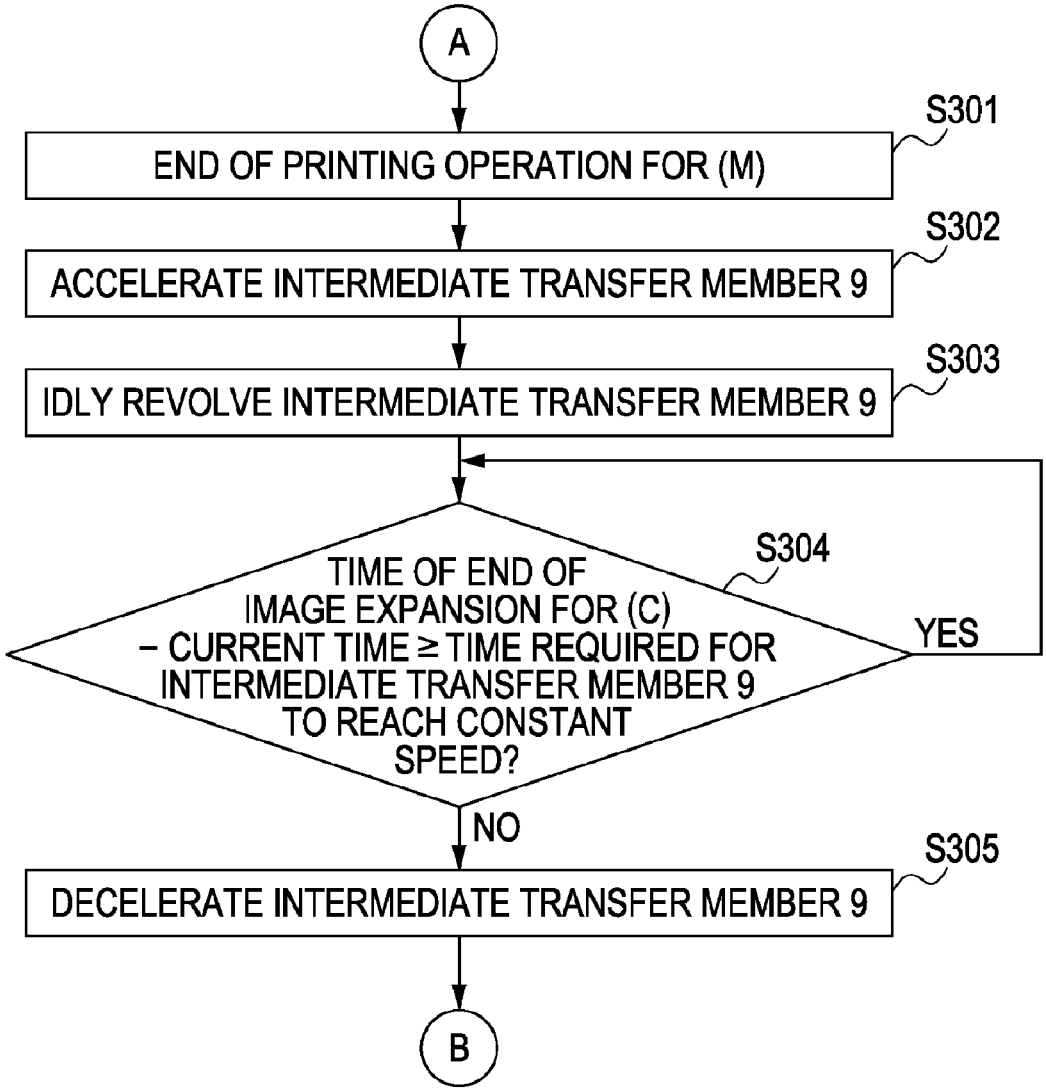
FIG. 9 is a flowchart when the printing operation is postponed by idly revolving the intermediate transfer member in the third exemplary embodiment.

On the other hand, if the comparison result in S204 indicates that the time of end of the image expansion for cyan is later, the printing operation for cyan is postponed by idly revolving the intermediate transfer member 9 (in a branch following a point A). The subsequent operation will be described in detail with reference to FIG. 9 illustrating a third exemplary embodiment.

When the HP mark 9*b* on the intermediate transfer member 9 is detected (S209) after returning the intermediate transfer member 9 to the constant speed, the engine control unit 202 transmits the /TOP signal to the controller 201 (S210). Upon receiving the /TOP signal, the controller 201 transmits the image information for cyan to the engine control unit 202 (S211). Upon receiving the image information for cyan, the engine control unit 202 starts the printing operation for cyan (S212).

As described above with reference to the timing chart of FIG. 5 and the flowchart of FIG. 8, when the image expansion is not completed until the timing of starting the printing operation, the printing operation can be postponed by decelerating the speed of the intermediate transfer member 9. On that occasion, the loss time caused by postponing the printing operation can be reduced by setting, based on the image expansion estimated time, the time at which the postponement of the printing operation is brought to an end. In other words, the printing operation can be postponed per color depending on the time required for the image expansion per color without idly revolving the intermediate transfer member 9 and without stopping the intermediate transfer member 9. As a result, prolongation of the FPOT can be suppressed minimum.

Third Exemplary Embodiment

A third exemplary embodiment can be practiced in the same configurations as those, illustrated in FIGS. 1 and 2, which have been described above in connection with the first exemplary embodiment, and hence a detailed description of the configurations is omitted. In the third exemplary embodiment, the driving speed of the intermediate transfer member 9 is variably controlled to postpone the printing operation by idly revolving the intermediate transfer member 9. The reason why the intermediate transfer member 9 is idly revolved unlike the above-described first and second exemplary embodiments resides in that the printing operation cannot be properly postponed only by control, which does not include the idle revolution, depending on the size of the recording medium 2. Stated another way, when the difference between the size of the recording medium 2 and the length of the intermediate transfer member 9 is small, a time from the end of the primary transfer for the previous color to the start of the primary transfer for the next color is fairly short. In such a case, a time required to stop or decelerate the intermediate transfer member 9 cannot be obtained at a sufficient value unless the intermediate transfer member 9 is idly revolved.

With this third exemplary embodiment, the loss time caused by postponing the printing operation can be reduced even when the printing operation is postponed by idly revolving the intermediate transfer member 9 as mentioned above. The operation of the third exemplary embodiment will be described in detail with reference to a timing chart and a flowchart.

Figure 6:
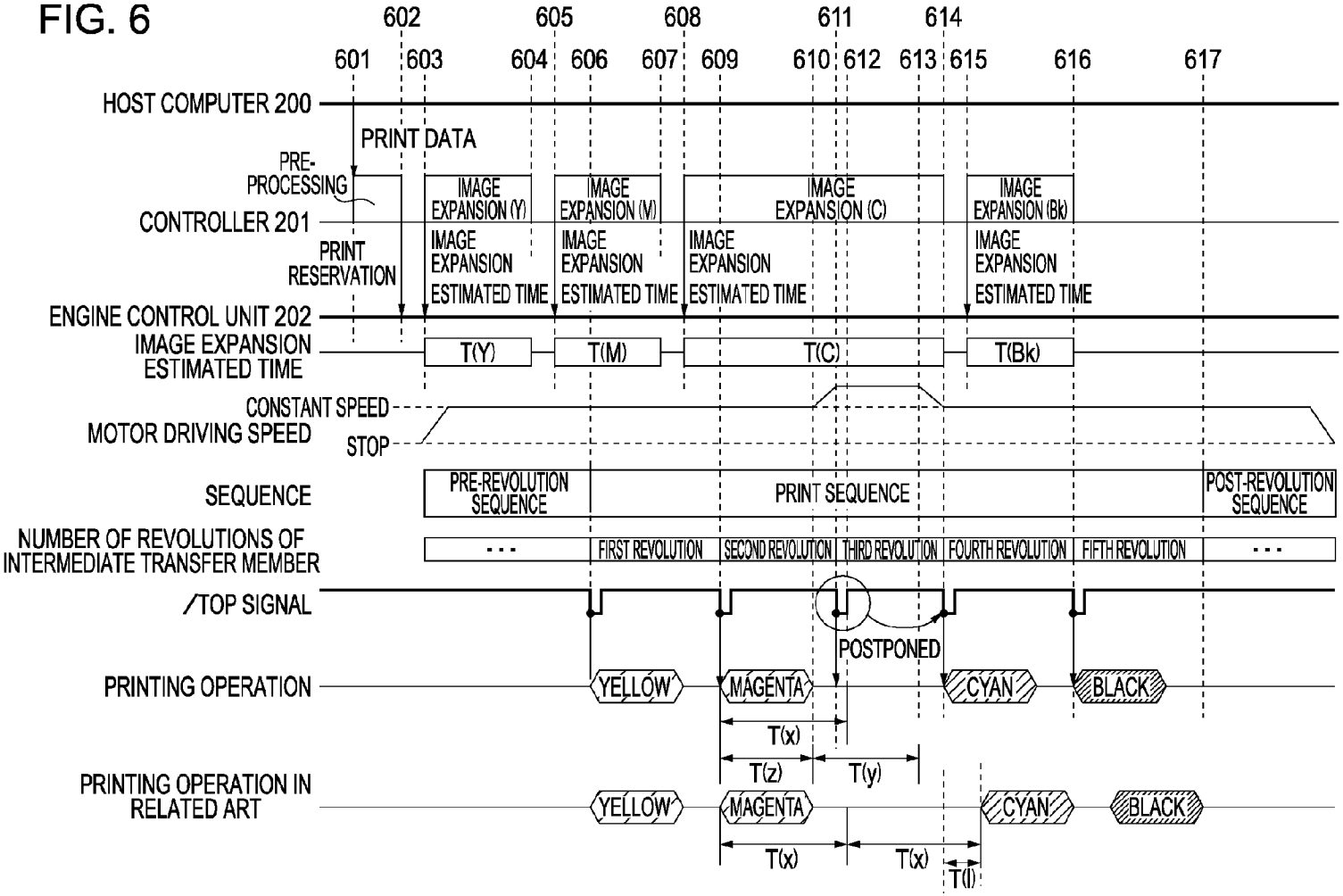
FIG. 6 is a timing chart when control is executed so as to postpone the image formation in a third exemplary embodiment by idly revolving the intermediate transfer member.

FIG. 6 is a timing chart when control is executed so as to reduce the loss time caused by postponing the printing operation even in the case of idly revolving the intermediate transfer member 9. Processes from 601 to 607 are the same as those from 301 to 307 described above with reference to FIG. 3 illustrating the first exemplary embodiment, and hence a description thereof is omitted. A process of postponing the printing operation is described below.

When the image expansion for magenta is completed (at a time 607), the controller 201 starts the image expansion for cyan and transmits the image expansion estimated time for cyan to the engine control unit 202 (at a time 608). Upon receiving the image expansion estimated time for cyan, the engine control unit 202 compares the "image expansion estimated time for cyan" with a "time (612) of transmission of the /TOP signal issued in the third revolution". In the illustrated example, the image expansion for cyan is not yet completed at the time of transmission of the /TOP signal issued in the third revolution. Accordingly, the printing operation is postponed.

When the printing operation is postponed, whether the intermediate transfer member 9 is to be idly revolved is first determined. It is here assumed that T(z) represents a time taken to perform the primary transfer onto the intermediate transfer member 9 as the printing operation for magenta, and T(y) represents a time (from 610 to 613) that can be postponed by varying the speed of the intermediate transfer member 9 during a period from the end of the image expansion for magenta to the time of transmission of the /TOP signal issued in the third revolution. The time T(z) is defined depending on the size of an image subjected to the primary transfer, and the time T(y) is defined depending on both the length of the intermediate transfer member 9 from the tailing end of the image after the primary transfer to the HP mark 9*b* and the speed of the intermediate transfer member 9.

In other words, if the image expansion for cyan is completed earlier than "the time of transmission of the /TOP signal issued in the second revolution+T(z)+T(y)", the printing operation can be postponed without idly revolving the intermediate transfer member 9. In the example of FIG. 6, however, since it is confirmed that the image expansion for cyan is not completed until reaching the above-mentioned time, the printing operation is postponed by idly revolving the intermediate transfer member 9. More specifically, after the printing operation for magenta is started (609) and is completed (610), the revolving speed of the intermediate transfer member 9 is accelerated (611) during a period in which the intermediate transfer member 9 is idly revolved. That acceleration process is intended to terminate the third revolution, in which the intermediate transfer member 9 is idly revolved, at an earlier timing such that the loss time is reduced to make the printing operation in the fourth revolution started at an earlier timing.

Note that the timing chart of FIG. 6 is merely one example and the intermediate transfer member 9 is not always required to be accelerated. Depending on the image expansion estimated time, though not shown, the printing operation in the fourth revolution can be started with a shorter loss time by keeping the intermediate transfer member 9 at the constant speed or by decelerating it. In such a case, the speed of the intermediate transfer member 9 may be kept at the constant speed or decelerated. Also, the intermediate transfer member 9 may be idly revolved once in combination of the acceleration, the deceleration, and the constant speed. Further, the intermediate transfer member 9 may be idly revolved plural times instead of once. When the image expansion is not completed even after idly revolving the intermediate transfer member 9 once, the intermediate transfer member 9 may be temporarily stopped, following which the printing operation may be postponed in the same manner as in the first exemplary embodiment.

A description is now made for the motion of the photosensitive drum 15 when the intermediate transfer member 9 is idly revolved for acceleration or deceleration. When a spacing mechanism capable of making the photosensitive drum 15 spaced from the intermediate transfer member 9 is provided, the photosensitive drum 15 is brought into a state spaced from the intermediate transfer member 9 while the intermediate transfer member 9 is idly revolved. When the spacing mechanism is not provided and the photosensitive drum 15 is held in a state contacting the intermediate transfer member 9, a bias is applied to the image on the intermediate transfer member 9 to prevent the image from being reversely transferred to the photosensitive drum 15 during the idle revolution. Further, the respective speeds of the intermediate transfer member 9 and the photosensitive drum 15 are set equal to each other to prevent the image from being disturbed due to the speed difference between the intermediate transfer member 9 and the photosensitive drum 15.

Thus, which one of the control methods according to the above-described exemplary embodiments is used to postpone the printing operation is determined depending on the time required for the image expansion. When the printing operation is postponed, the speed of the intermediate transfer member is not always required to be changed throughout a period during which the printing operation is postponed, i.e., a postponement time, and the speed may be variably controlled during only part of the postponement time. Any of those control methods can provide an advantage that the FPOT can be shortened in comparison with the related-art method of postponing the printing operation while the intermediate transfer member 9 is held at the constant speed.

After accelerating the intermediate transfer member 9, the engine control unit 202 compares a "remaining time until the end of the image expansion for cyan" with a "time required for the intermediate transfer member 9 to reach the constant speed with deceleration". When the "remaining time until the end of the image expansion for cyan" becomes equal to or shorter than the "time required for the intermediate transfer member 9 to reach the constant speed with deceleration", the engine control unit 202 starts to decelerate the intermediate transfer member 9 (at a time 613).

When the HP mark 9*b* on the intermediate transfer member 9 is detected after the intermediate transfer member 9 has been decelerated and returned to the constant speed, the engine control unit 202 transmits the /TOP signal to the controller 201 and receives the image information for cyan from the controller 201 to start the printing operation (at a time 614). Subsequent processes from 615 to 617 are the same as those from 311 to 315 described above with reference to FIG. 3, and hence a description thereof is omitted.

A row at the bottom of the timing chart of FIG. 6 represents the case where the printing operation is postponed according to the related art. When the printing operation is postponed according to the related-art method under the same conditions as those in this third exemplary embodiment, the intermediate transfer member 9 is caused to idly revolve once at the constant speed, as illustrated in the chart, after the end of the printing operation for magenta. Thus, the time T(x) required for the intermediate transfer member 9 to revolve once becomes the loss time. On the other hand, in this third exemplary embodiment, the printing operation for cyan is started earlier than in the related art by a time T(1), as seen from the chart. According to this third exemplary embodiment, therefore, the loss time can be cut by the time T(1) in comparison with the related art. Note that the exceptional processes described above in connection with the first exemplary embodiment can be similarly applied to the case where the printing operation is postponed through the control according to the timing chart illustrated in FIG. 6.

FIG. 9 is a flowchart when control is executed so as to reduce the loss time caused by postponing the printing operation even in the case of idly revolving the intermediate transfer member 9. The flowchart of FIG. 9 is intended to explain only the process of postponing the printing operation in more detail by extracting the corresponding part from the above description which has been made with reference to FIG. 6.

The processing before the point A in the flowchart of FIG. 9 has been described above in the second exemplary embodiment with reference to the flowchart of FIG. 8, and hence a detailed description thereof is omitted. If the comparison result in S204 of FIG. 8 indicates that the time of end of the image expansion for cyan is later, the printing operation for cyan is postponed by idly revolving the intermediate transfer member 9. More specifically, after the end of the printing operation for magenta (S301), the intermediate transfer member 9 is accelerated (S302) and is idly revolved once (S303). On that occasion, the intermediate transfer member 9 is not always required to be accelerated, as described above with reference to the timing chart of FIG. 6. Also, the intermediate transfer member 9 may be idly revolved plural times. The following description is made, for example, in connection with the case where the intermediate transfer member 9 is accelerated and is idly revolved in accordance with the timing chart of FIG. 6.

After accelerating the intermediate transfer member 9, the engine control unit 202 compares the remaining time until the end of the image expansion for cyan with the time required for the intermediate transfer member 9 to reach the constant speed from the accelerated state (S304). If the remaining time until the end of the image expansion for cyan is equal to or shorter than the time required for the intermediate transfer member 9 to reach the constant speed from the accelerated state, the intermediate transfer member 9 is decelerated for return to the constant speed to execute the printing operation (S305).

The reason why the comparison in S304 is performed resides in that a certain time is taken to decelerate the intermediate transfer member 9 from the accelerated state to the constant speed again at which the primary transfer can be performed. The engine control unit 202 previously holds the time taken to decelerate the intermediate transfer member 9 from the accelerated state to the constant speed. Accordingly, the loss time caused by postponing the printing operation can be reduced by comparing the time required for the intermediate transfer member 9 to reach the constant speed and the remaining time until the end of the image expansion for cyan with each other. The processing after a point B in the flowchart of FIG. 9 has been described above in the second exemplary embodiment with reference to the flowchart of FIG. 8, and hence a detailed description thereof is omitted.

While the above description has all been made, for example, in connection with the intermediate transfer member 9, the intermediate transfer member 9 may be, for example, a recording medium carrier for directly transferring an image to a recording medium. Even in such a case, the recording medium carrier can be controlled in a similar manner to that described above in connection with the intermediate transfer member 9.

As described above with reference to the timing chart of FIG. 6 and the flowchart of FIG. 9, when the image expansion is not completed until the timing of starting the printing operation, the printing operation can be postponed by idly revolving the intermediate transfer member 9. Even when the intermediate transfer member 9 is idly revolved, the loss time caused by postponing the printing operation can be reduced by setting, based on the image expansion estimated time, the time at which the postponement of the printing operation is brought to an end. In other words, the printing operation can be postponed per color depending on the time required for the image expansion per color regardless of the size of the recording medium (sheet) used in the printing. As a result, prolongation of the FPOT can be suppressed minimum.

Fourth Exemplary Embodiment

The first to third exemplary embodiments are applied to a color image forming apparatus including the developing rotary 23 and one photosensitive drum 15. A fourth exemplary embodiment is applied to a color image forming apparatus including four photosensitive drums 15 without using the developing rotary 23 (hereinafter referred to as the "in-line type").

Figure 10:
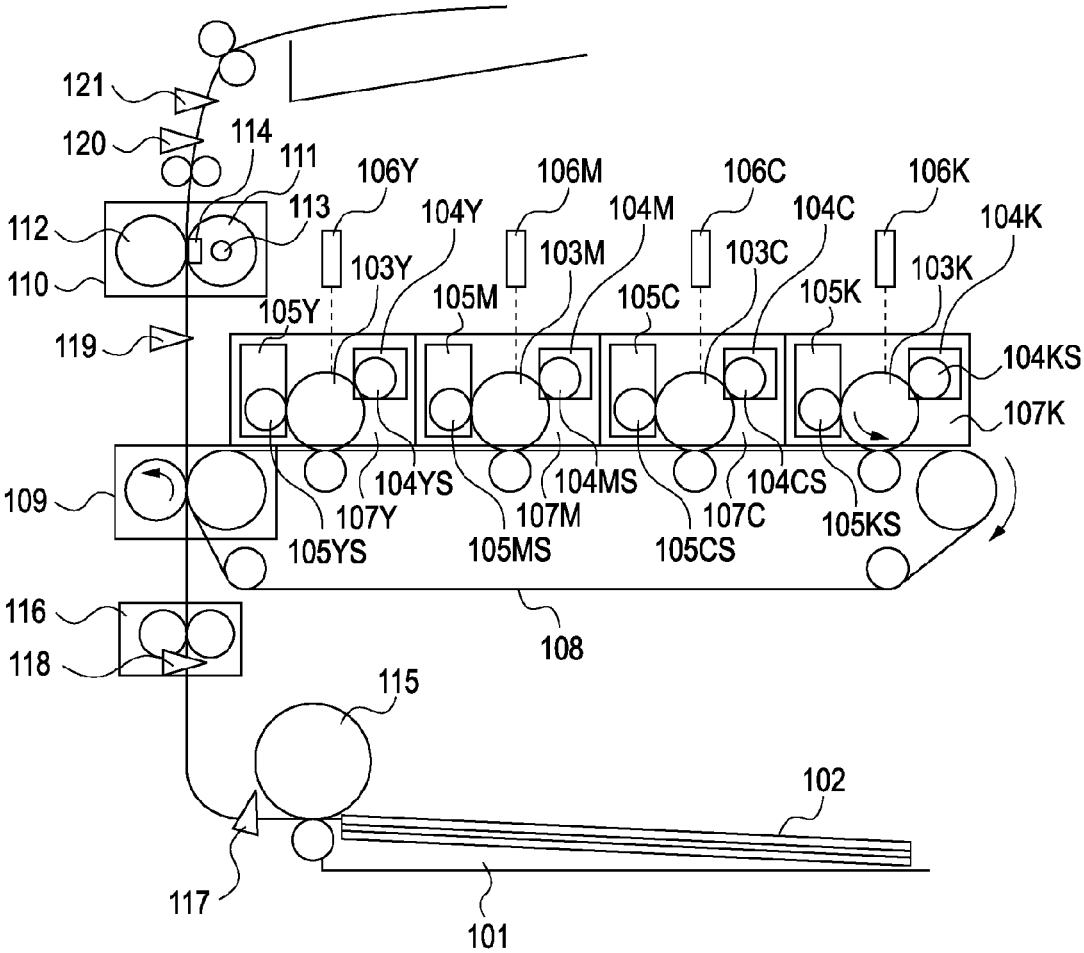
FIG. 10 is a schematic view illustrating an entire construction of an in-line type color image forming apparatus according to a fourth exemplary embodiment of the present invention.

FIG. 10 is a schematic view illustrating an example of an entire construction of the in-line type color image forming apparatus. Components of the in-line type color image forming apparatus will be first described below.

The color image forming apparatus includes a paper feed section 101 for supplying a recording medium 102, photosensitive drums 103Y, 103M, 103C and 103K prepared in a one-to-one relation to respective development colors, charging sections 104Y, 104M, 104C and 104K for charging the corresponding photosensitive drums, and developing sections 105Y, 105M, 105C and 105K for developing respective toner images on the corresponding photosensitive drums. The photosensitive drums, the charging sections, and the developing sections are mounted respectively to toner cartridges 107Y, 107M, 107C and 107K which are detachably attached to a main body of the in-line type color image forming apparatus.

Further, the in-line type color image forming apparatus includes a primary transfer section for transferring the developed toner images, an intermediate transfer member 108 onto which the toner images are transferred in the primary transfer section to form a color image, a secondary transfer section 109 for transferring the color image formed on the intermediate transfer member 108 to the recording medium 102, a fusing section 110 for fusing the toner images onto the recording medium 102, a paper feed roller 109, and a registration roller pair 116.

The charging sections 104Y, 104M, 104C and 104K for charging the photosensitive drums 103Y, 103M, 103C and 103K include charging rollers 104YS, 104MS, 104CS and 104KS for the respective colors. The photosensitive drums 103Y, 103M, 103C and 103K are rotated by driving forces transmitted from driving motors (not shown). The driving motors rotate the photosensitive drums 103Y, 103M, 103C and 103K in the predetermined direction, as indicated by arrow in FIG. 10, in accordance with the sequence of image forming processes. The photosensitive drums 103Y, 103M, 103C and 103K are exposed by scanner units 106Y, 106M, 106C and 106K such that the surfaces of the photosensitive drums 103Y, 103M, 103C and 103K are selectively exposed to form respective latent images thereon.

The developing sections 105Y, 105M, 105C and 105K for developing the latent images to the toner images include developing rollers 105YS, 105MS, 105CS and 105KS for the respective colors. The intermediate transfer member 108 is held in contact with the photosensitive drums 103Y, 103M, 103C and 103K, and it is revolved in the direction indicated by an arrow in FIG. 10 in a timed relation to rotations of the photosensitive drums 103Y, 103M, 103C and 103K during the color image forming process for primary transfer of the respective toner images onto the intermediate transfer member 108. The secondary transfer section 109 is held in contact with the intermediate transfer member 108 and is rotated in the direction indicated by an arrow in FIG. 10 with the revolution of the intermediate transfer member 108 for performing secondary transfer of the color image on the intermediate transfer member 108 to the recording medium 102 which is conveyed from the registration roller pair 116.

The fusing section 110 serves to fix the transferred color image while the recording medium 102 is conveyed. The fusing section 110 includes a fusing roller 111 for heating the recording medium 102, and a pressing roller 112 for pressing the recording medium 102 against the fusing roller 111. A heater 113 and a temperature sensor 114 are included in the fusing roller 111. More specifically, the recording medium 102 holding the color image thereon is conveyed in a state sandwiched between the fusing roller 111 and the pressing roller 112 such that the toners are fused onto the surface of the recording medium 102 under application of heat and pressure. After the fusing of the color image, the recording medium 102 is discharged to a paper discharge section, whereby the series of image forming operations is completed.

The following description is made for the case of applying, to the in-line type color image forming apparatus, the method of postponing the printing operation when the image expansion takes a long time and is not completed in time for the start of the printing operation, i.e., the method described above in the first to third exemplary embodiments.

Figure 11:
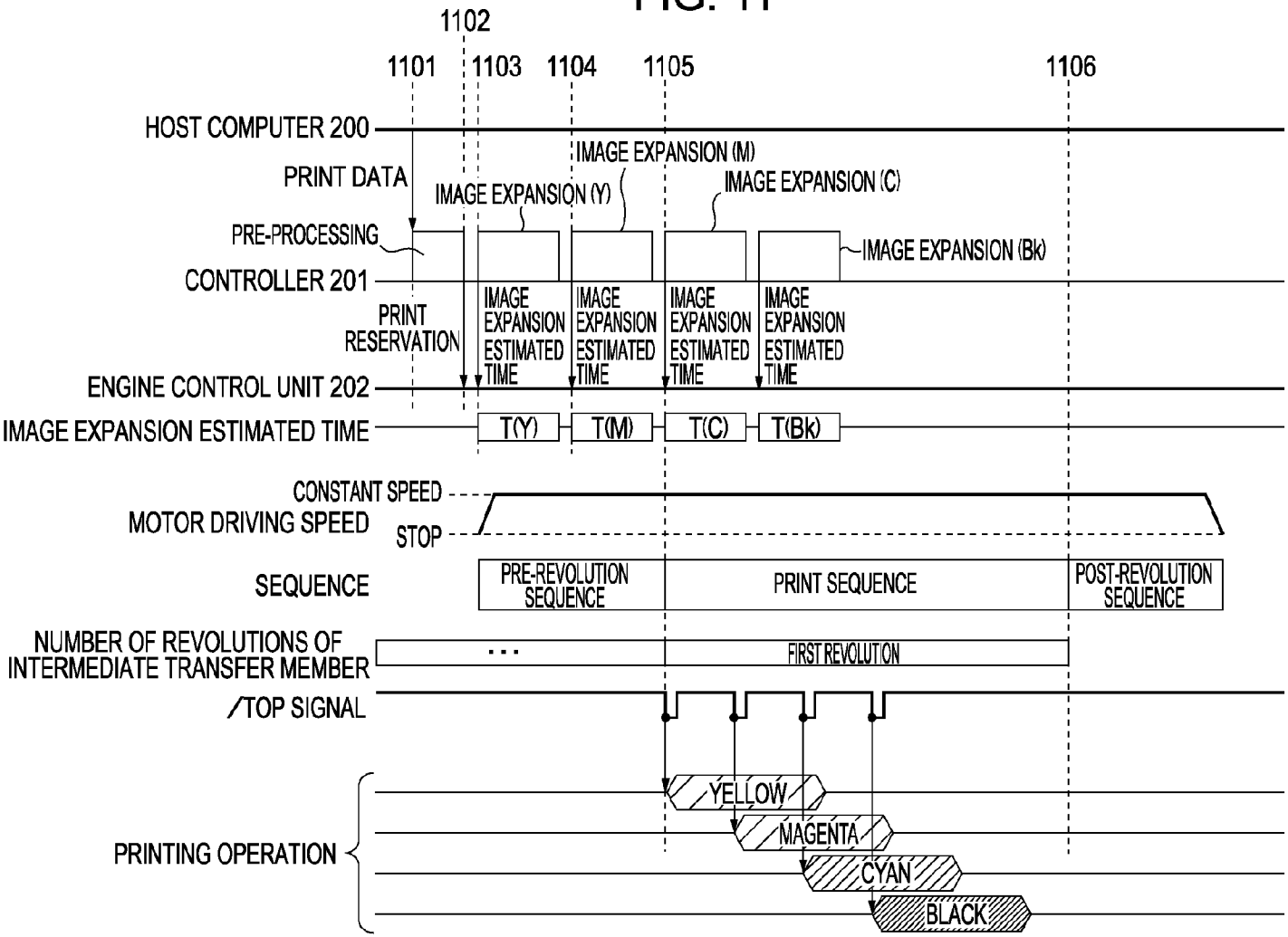
FIG. 11 is a timing chart illustrating an ordinary printing operation of the in-line type color image forming apparatus according to the fourth exemplary embodiment.
Figure 12:
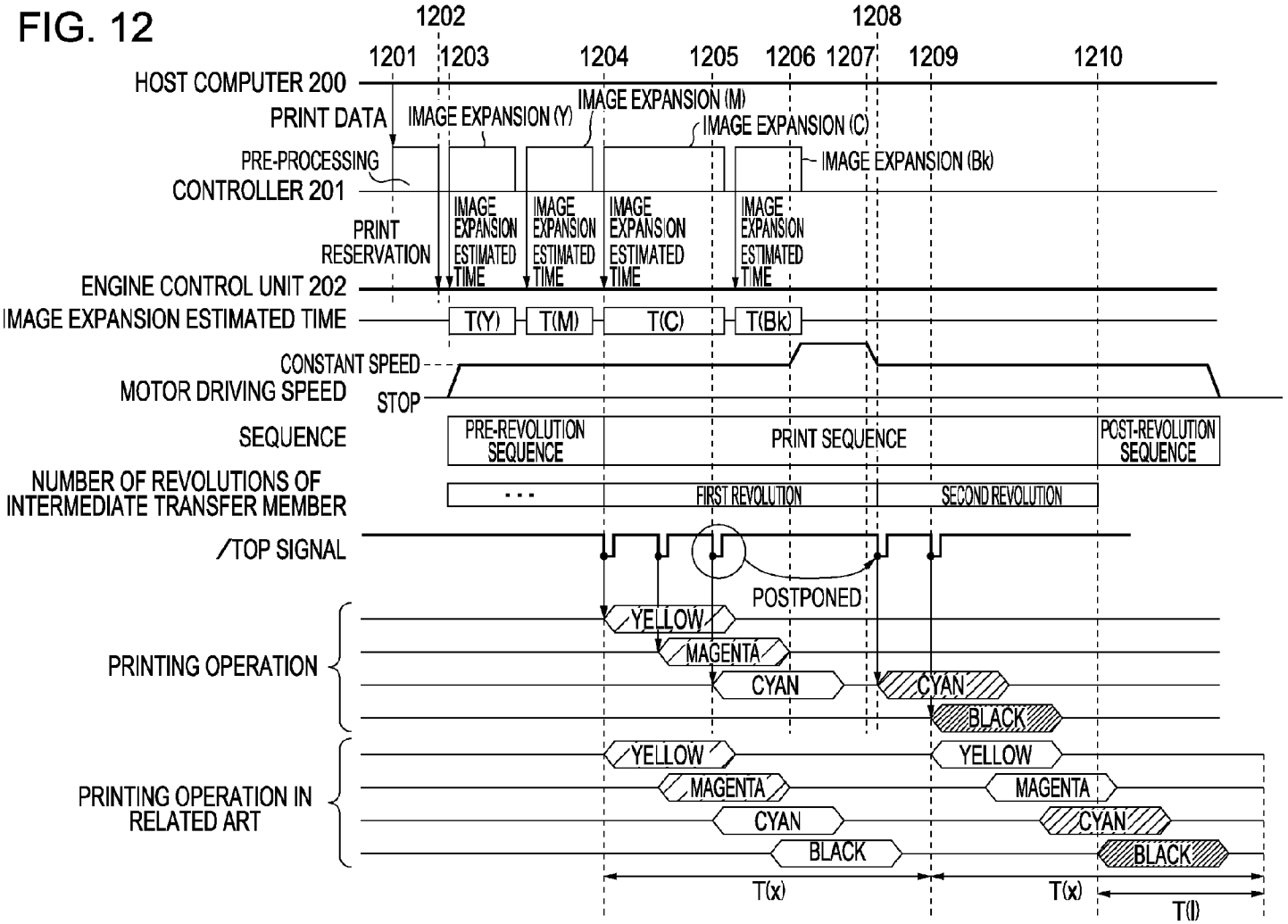
FIG. 12 is a timing chart when control is executed so as to postpone the image formation by idly revolving an intermediate transfer member of the in-line type color image forming apparatus in the fourth exemplary embodiment.

FIGS. 11 and 12 are timing charts to explain the fourth exemplary embodiment. FIG. 11 is a timing chart when the image expansion in the controller 201 and the printing operation in the engine control unit 202 are executed in parallel in the in-line type color image forming apparatus. An example of the case of executing the ordinary operation without postponing the printing operation is first described with reference to the timing chart of FIG. 11.

The controller 201 receives the print data from the host computer 200 (at a time 1101). Upon receiving the print data, the controller 201 analyzes the print data into data used to execute the image expansion in pre-processing and a print instruction (including the size and the type of a sheet, process conditions, etc.), and then transmits the print instruction, as a print reservation command, to the engine control unit 202 (at a time 1102).

Next, the controller 201 starts the image expansion per color based on the data that is contained in the print data and that is used for the image expansion. In this exemplary embodiment, the image expansion for yellow is first started. At the time of starting the image expansion, the controller 201 transmits the image expansion estimated time, which is obtained by estimating the processing time taken to execute the image expansion for yellow, to the engine control unit 202 (at a time 1103). Upon receiving the image expansion estimated time, the engine control unit 202 starts the pre-revolution sequence required to execute the image formation. Simultaneously, the engine control unit 202 compares the time required to execute the image expansion for yellow and the time required for the pre-revolution sequence with each other (1103).

After the completion of the image expansion for yellow, the controller 201 starts the image expansion for magenta and transmits the image expansion estimated time for magenta to the engine control unit 202 (at a time 1104). Then, the image expansions for cyan and black are successively executed in a similar manner. When the HP mark 9*b* on the intermediate transfer member 9 is detected after the end of the pre-revolution sequence, the engine control unit 202 transmits the /TOP signal to the controller 201 and receives the image information for yellow from the controller 201 to start the printing operation (at a time 1105).

Then, the engine control unit 202 successively receives the image information for magenta, cyan, and black from the controller 201 to start the printing operation per color in a similar manner. If the next print reservation command is not yet received at the time of completion of the printing operations for all the colors, the engine control unit 202 executes the post-revolution sequence (at a time 1106), whereby the printing operation is brought to an end.

The ordinary operation of the in-line type color image forming apparatus is executed as described above. An example of the case of postponing the printing operation when the image expansion process is not completed in due time during parallel processing of the image expansion by the controller 201 and the printing operation by the engine control unit 202 in the in-line type color image forming apparatus will be described below with reference to the timing chart of FIG. 12.

Processes from 1201 to 1203 are the same as those from 1101 to 1103 described above with reference to FIG. 11, and hence a description thereof is omitted. A process of postponing the printing operation is described below. When the image expansion for magenta is completed, the controller 201 starts the image expansion for cyan and transmits the image expansion estimated time for cyan to the engine control unit 202 (at a time 1204).

Upon receiving the image expansion estimated time for cyan, the engine control unit 202 compares the "image expansion estimated time for cyan" with a "time (1205) of transmission of the /TOP signal to start the printing operation for cyan". In the illustrated example, the image expansion for cyan is not yet completed at the time of transmission of the /TOP signal for cyan. Thus, the printing operation for cyan cannot be started and it is postponed.

More specifically, after the image expansion for magenta is started and is completed (1206), the intermediate transfer member 108 is accelerated. This acceleration process is intended to terminate not only the remaining idle period in the first revolution, but also an idle period in the second revolution corresponding to the printing operations for yellow and magenta, which have been already completed, at an earlier timing such that the loss time is reduced to make the printing operation started at an earlier timing for cyan in the second revolution.

After accelerating the intermediate transfer member 108, the engine control unit 202 compares a "remaining time until the start of the printing operation for cyan" with a "time required for the intermediate transfer member 108 to reach the constant speed with deceleration". When the "remaining time until the start of the printing operation for cyan" becomes equal to or shorter than the "time required for the intermediate transfer member 108 to reach the constant speed with deceleration", the engine control unit 202 starts to decelerate the intermediate transfer member 108 (at a time 1207).

When the HP mark on the intermediate transfer member 108 is detected after the intermediate transfer member 108 has been decelerated and returned to the constant speed, the engine control unit 202 transmits the /TOP signal to the controller 201 and receives the image information for cyan from the controller 201 to start the printing operation (at a time 1208).

Successively, the engine control unit 202 outputs the /TOP signal for black for which the image analyzing process is already completed, thus starting the image formation for black (at a time 1209). If the next print reservation command is not yet received at the time of completion of the printing operations for all the colors, the engine control unit 202 executes the post-revolution sequence (at a time 1210), whereby the printing operation is brought to an end.

A row at the bottom of the timing chart of FIG. 12 represents the case where the printing operation is postponed according to the related art. When the printing operation is postponed according to the related-art method under the same conditions as those in this fourth exemplary embodiment, the intermediate transfer member 108 is caused to idly revolve once at the constant speed, as illustrated in the chart, after the end of the printing operation for magenta. Thus, the time T(x) required for the intermediate transfer member 108 to revolve once becomes the loss time. On the other hand, in this fourth exemplary embodiment, the printing operation for cyan is started earlier than in the related art by a time T(1), as seen from the chart. According to this fourth exemplary embodiment, therefore, the loss time can be cut by the time T(1) in comparison with the related art. The relationship between the intermediate transfer member 108 and the photosensitive drum when the intermediate transfer member is revolved is similar to that described above in the third exemplary embodiment.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-222024 filed Aug. 29, 2008, which is hereby incorporated by reference herein in its entirety.

What is claimed is:

1. A color image forming apparatus comprising:

one image bearing member on which images are formed based on image information;

an intermediate transfer member onto which images in plural different colors formed on the image bearing member are transferred one color by one color in a superimposed relation;

an image forming unit configured to start image formation on the image bearing member in response to detection of a reference position on the intermediate transfer member; and a control unit configured to control a revolving speed of the intermediate transfer member to a constant speed such that the images in plural different colors formed on the image bearing member by the image forming unit are transferred onto the intermediate transfer member one color by one color, wherein, when transfer of the image onto the intermediate transfer member is not started at a predetermined timing after the detection of the reference position, the control unit executes control to temporarily change the revolving speed of the intermediate transfer member such that the transfer of the image onto the intermediate transfer member is started at the predetermined timing, and wherein the control unit holds the revolving speed of the intermediate transfer member at the constant speed during a period from start of the transfer of the image formed on the image bearing member to the intermediate transfer member until end of the transfer, and temporarily changes the revolving speed of the intermediate transfer member or temporarily stops the revolution of the intermediate transfer member during a period from the end of the transfer until detection of the reference position to start transfer of a next image.

2. The color image forming apparatus according to claim 1, wherein the control unit temporarily changes the revolving speed of the intermediate transfer member based on information regarding a time required for expansion of the image information.

3. The color image forming apparatus according to claim 1, wherein the transfer of the image onto the intermediate transfer member is started at the predetermined timing by temporarily stopping the revolution of the intermediate transfer member and thereafter returning the revolving speed of the intermediate transfer member to the constant speed without idly revolving the intermediate transfer member.

4. The color image forming apparatus according to claim 1, wherein the transfer of the image onto the intermediate transfer member is started at the predetermined timing by temporarily decelerating the revolving speed of the intermediate transfer member and thereafter returning the revolving speed of the intermediate transfer member to the constant speed without idly revolving the intermediate transfer member.

5. The color image forming apparatus according to claim 1, wherein the transfer of the image onto the intermediate transfer member is started at the predetermined timing by temporarily accelerating the revolving speed of the intermediate transfer member and thereafter returning the revolving speed of the intermediate transfer member to the constant speed during a period in which the intermediate transfer member is idly revolved.

6. The color image forming apparatus according to claim 1, wherein when a time required for expansion of the image information is longer than the sum of a time required for transferring the image onto the intermediate transfer member and a time required for returning to the constant speed after the intermediate transfer member has been temporarily stopped, the intermediate transfer member is temporarily stopped without idly revolving the intermediate transfer member after the image has been transferred onto the intermediate transfer member, and the revolving speed of the intermediate transfer member is returned to the constant speed such that the transfer of the image onto the intermediate transfer member is started at the predetermined timing.

7. The color image forming apparatus according to claim 1, wherein when a time required for expansion of the image information is shorter than the sum of a time required for transferring the image onto the intermediate transfer member and a time required for returning to the constant speed after the revolving speed of the intermediate transfer member has been decelerated, the revolving speed of the intermediate transfer member is temporarily decelerated without idly revolving the intermediate transfer member after the image has been transferred onto the intermediate transfer member, and the revolving speed of the intermediate transfer member is returned to the constant speed such that the transfer of the image onto the intermediate transfer member is started at the predetermined timing.

8. The color image forming apparatus according to claim 1, wherein when a time required for expansion of the image information is longer than the sum of a time required for transferring the image onto the intermediate transfer member and a time required for returning to the constant speed after the revolving speed of the intermediate transfer member has been decelerated, the revolving speed of the intermediate transfer member is temporarily accelerated during idle revolution of the intermediate transfer member after the image has been transferred onto the intermediate transfer member, and the revolving speed of the intermediate transfer member is returned to the constant speed such that the transfer of the image onto the intermediate transfer member is started at the predetermined timing.

9. A color image forming apparatus comprising:

a plurality of image bearing members on which images are formed based on image information with toners in plural different colors, respectively;

an intermediate transfer member onto which the images formed on the plurality of image bearing members are transferred in a superimposed relation;

an image forming unit configured to start image formation on the plurality of image bearing members in response to detection of a reference position on the intermediate transfer member; and;

a control unit configured to control a revolving speed of the intermediate transfer member to a constant speed such that the images in plural different colors formed on the image bearing member by the image forming unit are transferred onto the intermediate transfer member one color by one color;

wherein, when transfer of the image onto the intermediate transfer member is not started at a predetermined timing after the detection of the reference position, the control unit executes control to temporarily accelerate the revolving speed of the intermediate transfer member based on information regarding a time required for expansion of the image information such that the transfer of the image onto the intermediate transfer member is started at the predetermined timing.

10. A color image forming apparatus comprising:

one image bearing member on which images are formed based on image information;

an intermediate transfer member onto which images in plural different colors formed on the image bearing member are transferred one color by one color in a superimposed relation;

an image forming unit configured to start image formation on the image bearing member in response to detection of a reference position on the intermediate transfer member; and a control unit configured to control a revolving speed of the intermediate transfer member to a constant speed such that the images in plural different colors formed on the image bearing member by the image forming unit are transferred onto the intermediate transfer member one color by one color, wherein, when transfer of the image onto the intermediate transfer member is not started at a predetermined timing after the detection of the reference position, the control unit executes control to temporarily change the revolving speed of the intermediate transfer member such that the transfer of the image onto the intermediate transfer member is started at the predetermined timing, and wherein the transfer of the image onto the intermediate transfer member is started at the predetermined timing by temporarily stopping the revolution of the intermediate transfer member and thereafter returning the revolving speed of the intermediate transfer member to the constant speed without idly revolving the intermediate transfer member.

11. A color image forming apparatus comprising:

one image bearing member on which images are formed based on image information;

an intermediate transfer member onto which images in plural different colors formed on the image bearing member are transferred one color by one color in a superimposed relation;

an image forming unit configured to start image formation on the image bearing member in response to detection of a reference position on the intermediate transfer member; and a control unit configured to control a revolving speed of the intermediate transfer member to a constant speed such that the images in plural different colors formed on the image bearing member by the image forming unit are transferred onto the intermediate transfer member one color by one color, wherein, when transfer of the image onto the intermediate transfer member is not started at a predetermined timing after the detection of the reference position, the control unit executes control to temporarily change the revolving speed of the intermediate transfer member such that the transfer of the image onto the intermediate transfer member is started at the predetermined timing, and wherein the transfer of the image onto the intermediate transfer member is started at the predetermined timing by temporarily decelerating the revolving speed of the intermediate transfer member and thereafter returning the revolving speed of the intermediate transfer member to the constant speed without idly revolving the intermediate transfer member.

12. A color image forming apparatus comprising:

one image bearing member on which images are formed based on image information;

an intermediate transfer member onto which images in plural different colors formed on the image bearing member are transferred one color by one color in a superimposed relation;

an image forming unit configured to start image formation on the image bearing member in response to detection of a reference position on the intermediate transfer member; and a control unit configured to control a revolving speed of the intermediate transfer member to a constant speed such that the images in plural different colors formed on the image bearing member by the image forming unit are transferred onto the intermediate transfer member one color by one color, wherein, when transfer of the image onto the intermediate transfer member is not started at a predetermined timing after the detection of the reference position, the control unit executes control to temporarily change the revolving speed of the intermediate transfer member such that the transfer of the image onto the intermediate transfer member is started at the predetermined timing, and wherein the transfer of the image onto the intermediate transfer member is started at the predetermined timing by temporarily accelerating the revolving speed of the intermediate transfer member and thereafter returning the revolving speed of the intermediate transfer member to the constant speed during a period in which the intermediate transfer member is idly revolved.

13. The color image forming apparatus according to claim 10, wherein when a time required for expansion of the image information is longer than the sum of a time required for transferring the image onto the intermediate transfer member and a time required for returning to the constant speed after the intermediate transfer member has been temporarily stopped, the intermediate transfer member is temporarily stopped without idly revolving the intermediate transfer member after the image has been transferred onto the intermediate transfer member, and the revolving speed of the intermediate transfer member is returned to the constant speed such that the transfer of the image onto the intermediate transfer member is started at the predetermined timing.

14. The color image forming apparatus according to claim 11, wherein when a time required for expansion of the image information is shorter than the sum of a time required for transferring the image onto the intermediate transfer member and a time required for returning to the constant speed after the revolving speed of the intermediate transfer member has been decelerated, the revolving speed of the intermediate transfer member is temporarily decelerated without idly revolving the intermediate transfer member after the image has been transferred onto the intermediate transfer member, and the revolving speed of the intermediate transfer member is returned to the constant speed such that the transfer of the image onto the intermediate transfer member is started at the predetermined timing.

15. The color image forming apparatus according to claim 12, wherein when a time required for expansion of the image information is longer than the sum of a time required for transferring the image onto the intermediate transfer member and a time required for returning to the constant speed after the revolving speed of the intermediate transfer member has been decelerated, the revolving speed of the intermediate transfer member is temporarily accelerated during idle revolution of the intermediate transfer member after the image has been transferred onto the intermediate transfer member, and the revolving speed of the intermediate transfer member is returned to the constant speed such that the transfer of the image onto the intermediate transfer member is started at the predetermined timing.

16. The color image forming apparatus according to claim 10, wherein the control unit temporarily changes the revolving speed of the intermediate transfer member based on information regarding a time required for expansion of the image information.

17. The color image forming apparatus according to claim 11, wherein the control unit temporarily changes the revolving speed of the intermediate transfer member based on information regarding a time required for expansion of the image information.

18. The color image forming apparatus according to claim 12, wherein the control unit temporarily changes the revolving speed of the intermediate transfer member based on information regarding a time required for expansion of the image information.

* * * * *